US005800063A

United States Patent [19]

Stanley

[11] Patent Number: 5,800,063

[45] Date of Patent: Sep. 1, 1998

[54] HYDRAULIC OIL WELL PUMP DRIVE SYSTEM

[76] Inventor: Lloyd Stanley, No. 1, 1504 First Street South, Cranbrook, British Columbia, Canada, V1C 1A2

[21] Appl. No.: 812,723

[22] Filed: Mar. 6, 1997

Related U.S. Application Data

[63] Continuation of Ser. No. 845,379, Mar. 3, 1992, abandoned, Ser. No. 967,411, Oct. 26, 1992, abandoned, Ser. No. 163,185, filed as PCT/CA93/00085, Mar. 7, 1993, Pat. No. 5,447,026, and Ser. No. 447,193, May 22, 1995.

[51] Int. Cl.[6] ..... F16C 29/02

[52] U.S. Cl. ..... 384/29

[58] Field of Search ..... 384/29, 41, 38, 384/32, 31, 30

[56] References Cited

U.S. PATENT DOCUMENTS

| | | | |
|---|---|---|---|
| 4,085,796 | 4/1978 | Council | 166/77.53 |
| 4,289,294 | 9/1981 | McLean | 251/62 |
| 4,712,620 | 12/1987 | Lim et al. | 166/355 |
| 5,447,026 | 9/1995 | Stanley | 60/372 |

*Primary Examiner*—Lenard A. Footland
*Attorney, Agent, or Firm*—Lee & Hayes, PLLC

[57] ABSTRACT

A hydraulic oil well pump drive system for driving an oil well sucker rod includes a wellhead hydraulic assembly that is operably connected to the oil well sucker rod to reciprocate the sucker rod. The wellhead hydraulic assembly includes a hydraulic cylinder and a rod that reciprocates linearly within the hydraulic cylinder. The rod has an upper end with a circumferential groove that receives a split cylindrical bearing. The split cylindrical bearing is has two semicircular halves retained within the groove by the inner walls of the cylinder. The halves are retained vertically, relative to the rod, by the groove itself.

7 Claims, 16 Drawing Sheets

HYDRAULIC OIL WELL PUMP DRIVE SYSTEM

RELATED APPLICATIONS

This application is a continuation of a prior U.S. patent application by the same inventor filed Mar. 3, 1992, entitled "Hydraulic Oil Well Pump Drive" Ser. No. 07/845,379, abandoned; of a prior U.S. patent application by the same inventor filed Oct. 26, 1992, entitled "Hydraulic Oil Well Pump Drive System" Ser. No. 07/967,411, abandoned; of a prior U.S. patent application by the same inventor filed Dec. 6, 1993, entitled "Hydraulic Oil Well Pump Drive System" Ser. No. 08/163,185, issued Sep. 5, 1995 as U.S. Pat. No. 5,447,026; of a Patent Cooperation Treaty patent application by the same inventor filed in Canada on Mar. 1, 1993, entitled "Hydraulic Oil Well Pump Drive System" serial number PCT/CA93/00085; and of a prior U.S. patent application by the same inventor filed filed May 22, 1995, entitled Hydraulic Oil Well Pump Drive System" Ser. No. 08/447,193.

TECHNICAL FIELD

This invention relates to hydraulic drive systems for oil well pumps.

BACKGROUND OF THE INVENTION

Oil wells vary in depth from a few hundred feet to up to 14,000 feet. Oil is lifted from these depths by a plunger which reciprocates within a pump barrel at the bottom of the well. The plunger is driven by a sucker rod or an interconnected series of sucker rods which extend down from the surface of the oil well to the plunger.

FIG. 1 shows a conventional pump jack 10 for driving the sucker rod of an oil well pump. Pump jack 10 generally comprises a walking beam 12 which is connected through a polished rod 14 to an in-hole sucker rod (not shown). Walking beam 12 is pivotally supported at an intermediate position along its length by a samson post 16, which is in turn mounted to a base frame 18. A drive crank system 20 is also mounted to base frame 18. Base frame 18 is mounted to a concrete base to rigidly locate all components relative to the oil well.

Drive crank system 20 has a rotating eccentric crank arm 24. Crank arm 24 is driven at a constant speed by an electric or gas motor in combination with a gearbox or reducer, generally designated by the reference numeral 26. Eccentric crank arm 24 rotates about a horizontal axis.

Walking beam 12 has a driven end 30 and a working end 32 on either side of its pivotal connection to samson post 16. One or more pitman arms 34 extend from driven end 30 to a crank pin 35 positioned intermediately along outwardly extending eccentric crank arm 24. Rotation of crank arm 24 is translated by pitman arms 34 into vertical oscillation of the walking beam's driven end 30 and corresponding oscillation of working end 32.

Working end 32 of walking beam 12 has an arcuate cable track or horsehead 36. A cable 38 is connected to the top of the cable track 36. Cable 38 extends downwardly along the cable track 36 and is connected at its lower end to polished rod 14. Pivotal oscillation of walking beam 12 thus produces corresponding vertical oscillation of polished rod 14 and of the connected sucker rod. The arcuate shape of cable track 36 ensures that forces between working end 32 and polished rod 14 remain vertically aligned at all positions of walking beam 12.

The sucker rod of an oil well pump performs its work during an upward stroke, when oil is lifted from the well. No pumping is performed during the downward stroke of the sucker rod. Accordingly, a pump jack such as described above supplies force to a sucker rod primarily during its upward stroke. Relatively little force is produced on the downward stroke. To increase efficiency of a drive system counterbalance weights are utilized to store energy during the sucker rod downward stroke and to return that energy to assist in the sucker rod upward stroke.

In pump jack 10, counterbalance weights 40 are positioned at the outermost end of crank arm 24. Such weights could also be positioned on the driven end 30 of walking beam 12. However, a mechanical advantage is obtained by placing the weights outward along the crank arm from the pitman arm connection. During the downstroke of the sucker rod the driving motor must supply energy to raise weights 40 to the top of their stroke. During the sucker rod's upstroke, however, weights 40 assist the motor and gearbox since the outward end of crank arm 24 moves downward while the sucker rod moves upward. The peak energy required by the motor is therefore greatly reduced, allowing a smaller motor to be used with corresponding increases in efficiency.

Mechanical pump jacks such as described above have been used for many years and continue to be used nearly exclusively for driving oil well pumps. Acceptable substitutes have simply been unavailable. One reason for the popularity of such mechanical systems is their extreme simplicity. They do not involve valves, switches, or electronics, and there are a minimum of moving parts. This simplicity results in reliability which is difficult to accomplish with more complex systems. Reliability is of utmost importance since oil well pumps are unattended for long periods, often being located in remote locations.

The very nature of sucker rod displacement created by a reciprocating pump jack is another apparent reason for its success. An oil well sucker rod is often over 14,000 feet long. While reciprocating, it must not only accelerate and decelerate itself, but also a 14,000 foot oil column. In addition, it must accelerate and decelerate oil within an above-surface production line, which can be as long as five miles. Forces caused by sudden acceleration of the sucker rod are therefore very significant. Any such sudden or undue acceleration can stretch and snap the sucker rod.

The pump jack described above minimizes acceleration and deceleration forces on the sucker rod by producing an approximately sinusoidal displacement at the polished rod. The sinusoidal displacement results from translation of rotary crank motion to linear motion at the polished rod. Such sinusoidal motion significantly reduces strain on the driven sucker rod.

However, while the pumping action of a mechanical pump jack is preferable to previously-known alternatives, its physical size creates significant disadvantages. For instance, the great weight of the walking beam, gearbox, and counterbalance weights requires expensive support bases and land site preparation. Rates of reciprocation are often limited by this weight. In addition, pump jacks must be attached permanently above a wellhead and are therefore not easily moved to another site. This results in costly pumping equipment sitting idle during periods of oil well inactivity.

While alternative drive systems have been attempted, none have met with significant commercial success. FIG. 2 illustrates one prior art drive system, comprising a hydraulic pump drive system which is generally designated by the reference numeral 50. Drive system 50 includes a hydraulic cylinder 52 containing a piston assembly 54. Piston assembly 54 is designed for reciprocal vertical motion within cylinder 52. It comprises an elongated center shaft 56 having a pressure piston 58 on its upper end and a working piston 60 at an intermediate position along its length. Center shaft 56 has a lower end which is connected through a coupling 62 to a polished rod 64.

Cylinder 52 has a centrally located annular flange 66 which seals against center shaft 56 between pressure piston 58 and working piston 60 to divide cylinder 52 into an upper pressure chamber 68 and a lower working chamber 70. Pressure piston 58 reciprocates within pressure chamber 68 and working piston 60 reciprocates within working chamber 70.

Piston assembly 54 is driven up and down by hydraulic force applied alternately to the bottom and then the top of working piston 60. A hydraulic pump 72 supplies hydraulic fluid under pressure from a reservoir 74 to a cross-over hydraulic valve 76. Valve 76 is in fluid communication with working chamber 70 through fluid ports both above and below working piston 60. A lower limit switch 78 and an upper limit switch 80 are actuated by a switch actuator 82 which travels up and down with center shaft 56. Actuator 82 actuates lower limit switch 78 at the bottom of desired piston assembly travel, causing cross-over valve 76 to supply pressurized hydraulic fluid to working chamber 70 below working piston 60. This forces piston assembly 54 upward. Actuator 82 actuates upper limit switch 80 at the top of desired piston assembly travel, causing cross-over valve 76 to supply pressurized hydraulic fluid to working chamber 70 above working piston 60. This forces piston assembly 54 back down. Hydraulic fluid displaced by piston 60 from the non-pressurized side of working piston 60 is returned through valve 76 into fluid reservoir 74.

Pressure chamber 68 is filled with hydraulic fluid below pressure piston 58 and is connected for fluid communication with an accumulator cylinder 84. Accumulator cylinder 84 has a free-floating piston 86 which divides accumulator cylinder 84 into a hydraulic fluid chamber 88 and a gas chamber 90. Hydraulic fluid displaced from pressure chamber 68 by the downward movement of pressure piston 58 is forced into hydraulic fluid chamber 88, forcing free-floating piston 86 toward gas chamber 90. Gas chamber 90 contains pressurized gas which opposes such movement.

Hydraulic drive system 50 thus provides a hydraulic mechanism for alternately moving a sucker rod upward and downward. Furthermore, the opposing pressure of the pressurized gas within gas chamber 90 assists in the upward stroke of piston assembly 56 and the connected sucker rod. This allows using a smaller hydraulic pump than would otherwise be necessary. The drive system does not, however, address the problems of sudden sucker rod acceleration and deceleration. In fact, the significant force applied to the sucker rod is subject to sudden and complete reversal at both the top and bottom of each sucker rod stroke. The resulting acceleration and deceleration tends to greatly reduce the life of a sucker rod.

Attempts have been made to reduce the sudden acceleration and deceleration which often occurs at the point of stroke reversal in prior art hydraulic pump drive systems. For instance, U.S. Pat. No. 2,555,426 to W. C. Trautman et al. describes using a gas accumulator connected to a hydraulic pressure line which feeds a hydraulic drive cylinder. The gas accumulator is said to maintain a constant pressure on a polished rod so that the velocity of the polished rod can vary according to the resistance encountered and produced by the polished rod and connected sucker rod. However, such an accumulator produces a great degree of elasticity in the drive system, often resulting in uncontrolled and erratic sucker rod displacement. Such uncontrolled displacement itself is a cause of unacceptable acceleration and deceleration. The elasticity in the Trautman drive system prevents it from producing the constant, sinusoidal motion of a pump jack, which experience has proven to be preferable.

The Trautman patent also describes a rather complex valving system intended to modulate the reversal of hydraulic oil pressure to the drive cylinder. Recognizing the desirability of reducing acceleration extremes, Trautman proposes a mechanism for decelerating the drive piston rapidly but uniformly at the end of its stroke, and then accelerating it as rapidly as possible at the beginning of the next stroke (column 9, lines 26–34). Using this approach, full hydraulic pressure is applied at the beginning of each stroke, causing rapid and uncontrolled acceleration of the polished rod and connected sucker rod.

The Trautman mechanism and similar devices have failed to gain any significant acceptance as replacements for mechanical pump jacks. One of the primary disadvantages of such prior art mechanisms is that they involve complex i valving systems. Often, the mechanisms require numerous valves, hydraulic pumps, displacement and velocity sensors, and other electronic equipment. Such complexities greatly diminish reliability.

In contrast to the valved mechanisms described above, some prior art systems have used crank-type mechanical drives to reciprocate a master cylinder assembly. U.S. Pat. No. 2,526,388 to William Otto Miller is an example of an oil well pump drive system which uses a mechanically-driven master piston. While drive systems such as described by Miller are significantly simpler than systems utilizing hydraulic switching, they have not been proven to be reliable enough to replace conventional pump drive systems. One significant disadvantage of the Miller system is the driving apparatus used in its master cylinder, shown in FIG. 2 of the Miller patent. The master cylinder utilizes what is known as a "Scotch Crosshead." While this driving arrangement produces a linear displacement thought by Miller to be an improvement over the prior art, it requires a number of sliding surfaces and results in off-center or angularly-misaligned forces which tend to reduce the life of the master cylinder components. The Miller system, perhaps in part because of these reasons, has not been commercially accepted.

The Miller system also does not address the problem of oil leakage in hydraulic systems. Oil leakage can be a significant problem with pumping systems which are installed for continuous and unattended operation for long periods. An automatic method of monitoring and replenishing oil is needed which as will not add undue complexity and cost.

The invention described below eliminates virtually all of the complexities of the prior art devices. This results in a hydraulic drive system which emulates the motion of a mechanical pump jack while requiring no valves or variable restrictions during its normal operation. Furthermore, the unique master cylinder mounting arrangement used in the invention eliminates off-center or angularly-misaligned forces at the master cylinder assembly. While providing simplicity in both construction and operation, the preferred embodiment of the invention includes means for automatically regulating pump stroke and for monitoring and automatically replenishing leaked oil. The further advantages of the invention over both mechanical pumping jacks and over prior art hydraulic pump drives will be apparent from the discussion below.

BRIEF DESCRIPTION OF THE DRAWINGS

Preferred embodiments of the invention are described below with reference to the accompanying drawings, in which:

FIG. 7 is a schematic view of a hydraulic oil well pump drive system in accordance with a third preferred embodiment of the invention;

DETAILED DESCRIPTION OF THE PREFERRED EMBODIMENTS

This disclosure of the invention is submitted in furtherance of the constitutional purposes of the U.S. Patent Laws "to promote the progress of science and useful arts." U.S. Constitution, Article 1, Section 8.

Figure 1:
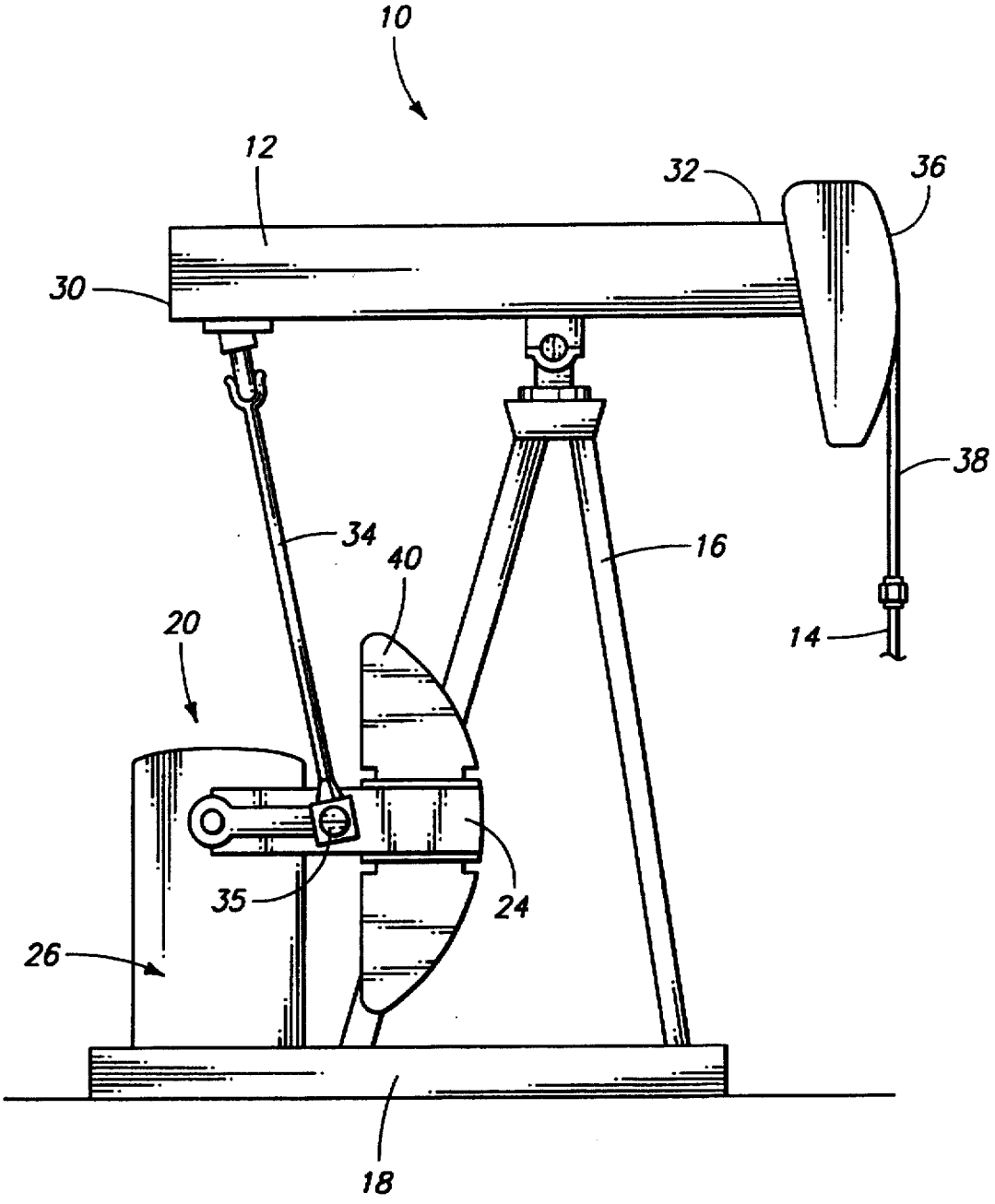
Fig 1 PRIOR ART
FIG. 1 is a side view of a prior art oil well pump jack.
Figure 2:
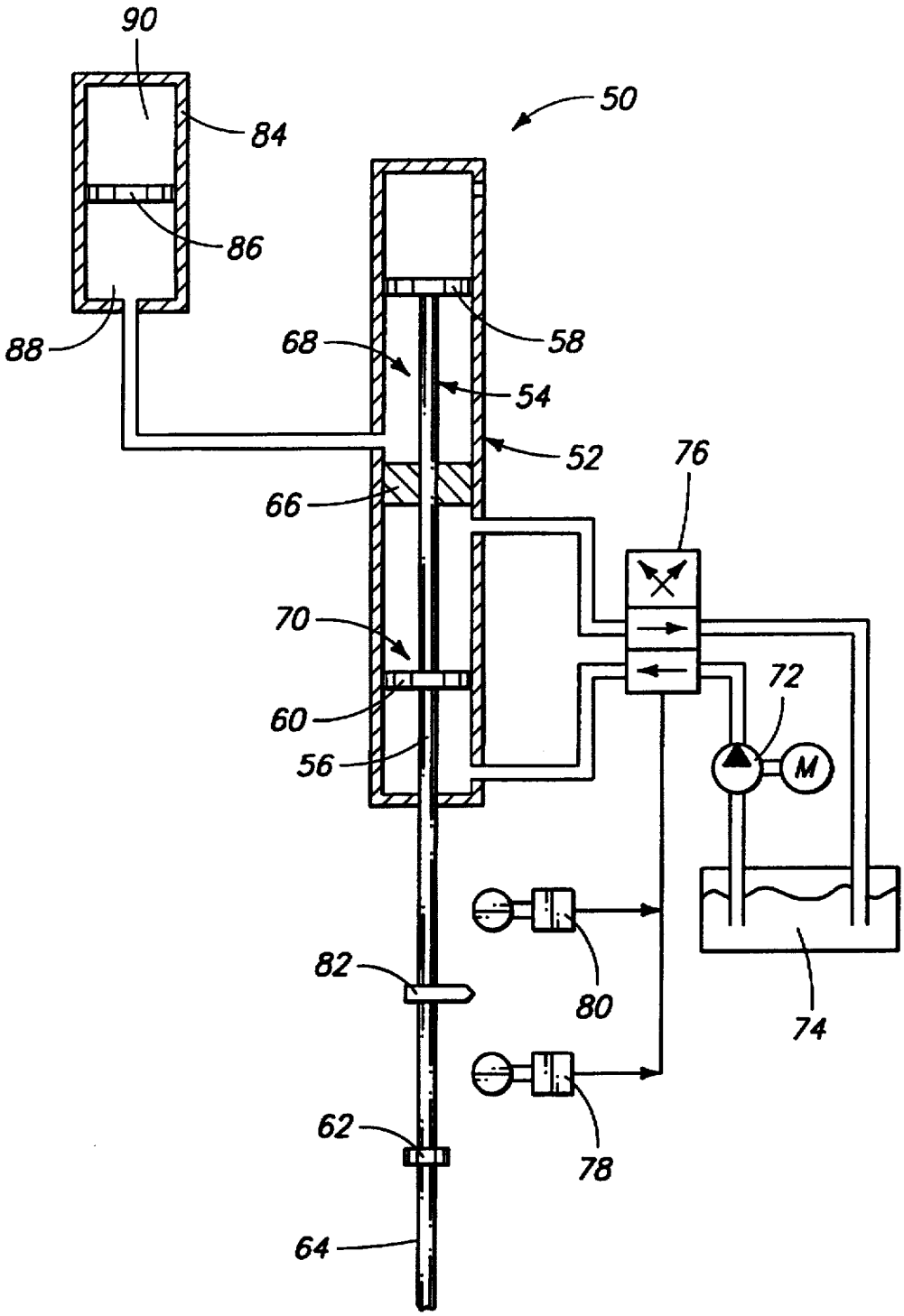
Fig 2 PRIOR ART
FIG. 2 is a schematic view of a prior art hydraulic oil well pump drive.
Figure 3:
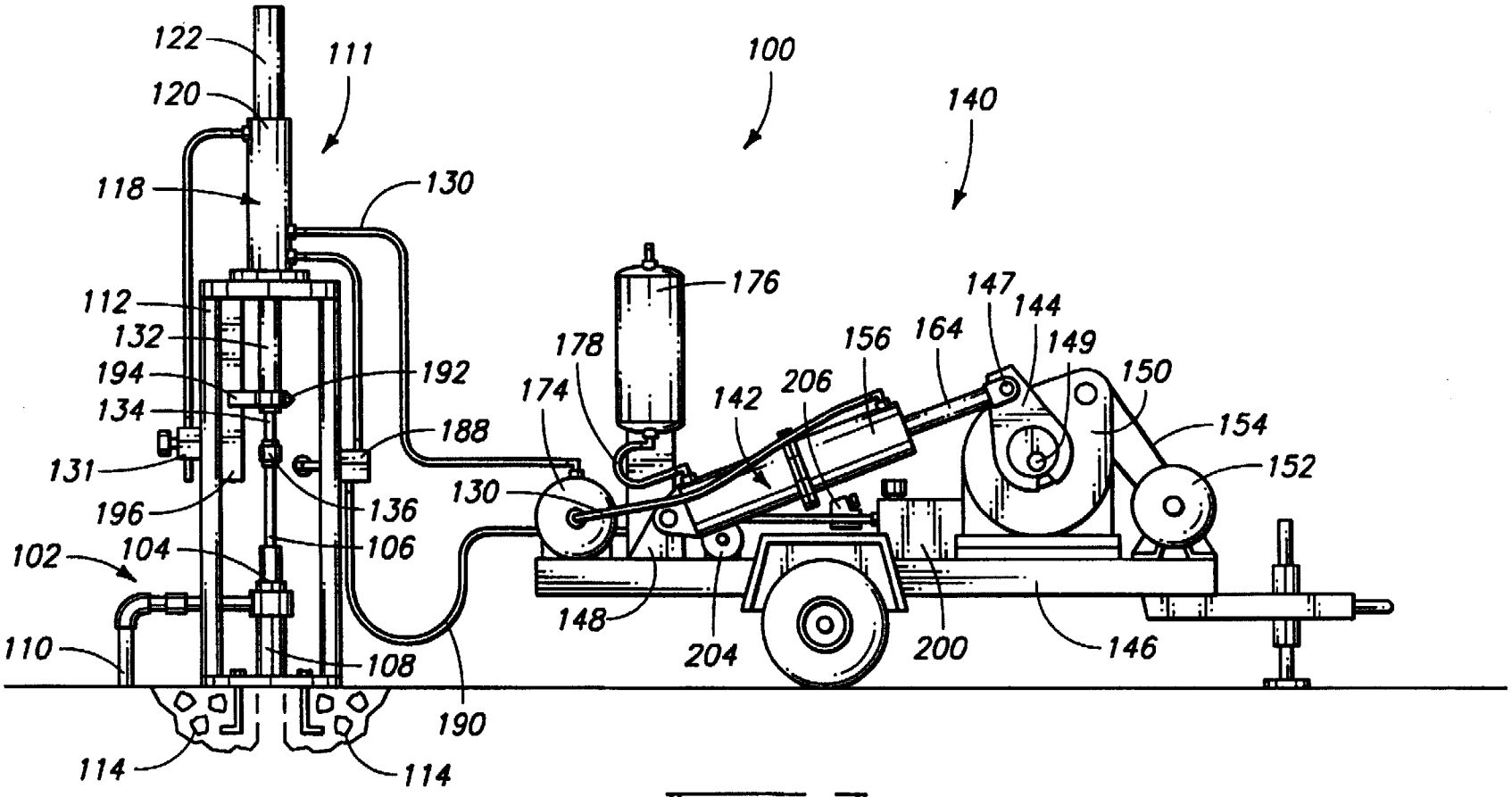
FIG. 3 is a side view of a hydraulic oil well pump drive system in accordance with a first preferred embodiment of the invention.
Figure 4:
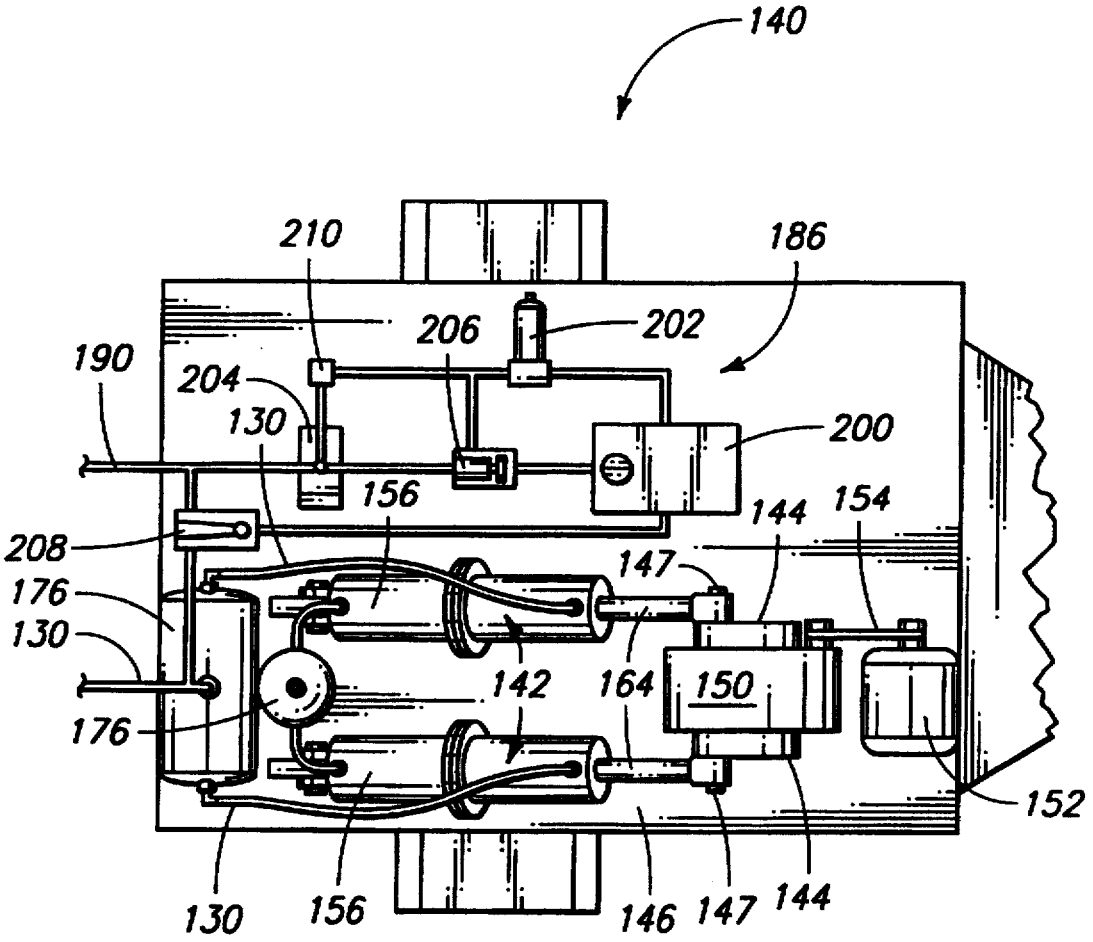
FIG. 4 is a top view of the drive system shown in FIG. 3.
Figure 5:
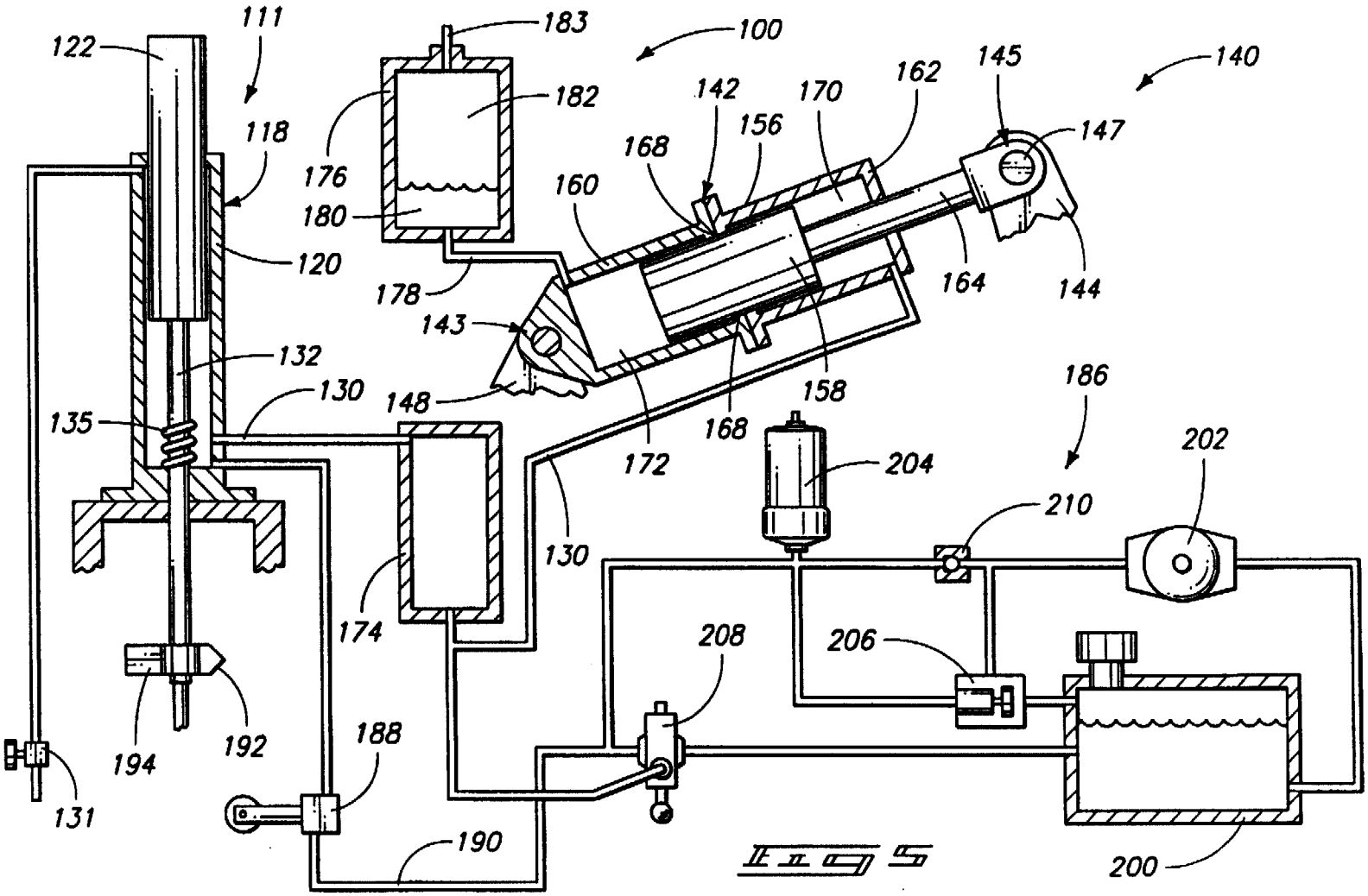
FIG. 5 is a schematic view of a the drive system shown in FIGS. 3 and 4.

FIGS. 3–5 show a hydraulic oil well pump drive system in accordance with a first preferred embodiment of the invention, generally designated by the reference numeral 100. Drive system 100 is located at a conventional oil wellhead 102. Wellhead 102 has a stuffing box assembly 104 which receives a polished rod 106 therethrough. Polished rod 106 oscillates or reciprocates in a vertical direction, extending downward through a well casing 108 to a sucker rod (not shown). The sucker rod extends downward through well casing 108 to a plunger (not shown) at the bottom of the oil well. The plunger is oscillated by the sucker rod to lift oil to the surface and to pump said oil through a production line 110 to a reservoir or remote location.

A wellhead hydraulic assembly 111 is mounted directly over wellhead 102 to drive the oil well sucker rod. Wellhead hydraulic assembly 111 includes a fixed vertical wellhead frame 112 which is mounted or fastened to a concrete base 114.

Wellhead hydraulic assembly 111 is operably connected to the oil well sucker rod to alternately and reciprocally displace the sucker rod in opposite vertical directions. It includes a wellhead slave cylinder and piston assembly 118 having a wellhead slave piston 122 within a wellhead slave cylinder 120. An air bleed valve 131 is connected for fluid communication with the top of slave cylinder 120 to allow entrapped air within slave cylinder 120 to escape. Wellhead slave cylinder and piston assembly 118 receives a working fluid flow through a hydraulic supply line 130. The working fluid flow is bi-directional, alternating in direction between a positive fluid flow into slave cylinder 120 and a negative fluid flow out from cylinder 120. The bi-directional working fluid flow produces relative reciprocal motion between wellhead piston 122 and wellhead cylinder 120. Positive flow of hydraulic fluid, into wellhead cylinder 120 through supply line 130, raises wellhead piston 122 at a rate which is directly proportional to the rate of incoming fluid flow. Negative hydraulic fluid flow, out from wellhead cylinder 120, lowers wellhead piston 122 at a rate proportional to the rate of outgoing fluid flow.

A slave piston rod 132 extends downward from wellhead piston 122, through wellhead cylinder 120, and connects to a connector link 134. Connector link 134 is in turn connected to polished rod 106 by a polished rod clamp assembly 136. Wellhead cylinder 120 and wellhead piston 122 are thus operably connected between wellhead frame 112 and the oil well sucker rod to displace the sucker rod alternately up and down at the same rate as the rate of hydraulic flow through supply line 130. A cushioning spring 135 surrounds piston rod 132. It is positioned beneath slave piston 122 to mitigate the impact of the slave piston which might result from a sudden loss of hydraulic pressure.

Drive system 100 also includes a master hydraulic source or supply assembly 140 for driving wellhead slave cylinder and piston assembly 118. Supply assembly 140 is of a type which produces an alternating bi-directional flow of working fluid to and from wellhead assembly 118 to reciprocally displace the oil well sucker rod between upper and lower extremes. Supply assembly 140 thus forms means for displacing a working fluid such as hydraulic oil or fluid to produce a bi-directional working fluid flow, wherein the direction of the working fluid flow alternates between a positive, outward displacement of hydraulic fluid from supply assembly 140 and a negative, inward displacement into supply assembly 140. The rate of the bi-directional working fluid flow is approximately sinusoidal as a result of the unique driving mechanism described below. Supply assembly 140 is in fluid communication with wellhead cylinder assembly 118, supplying the working fluid flow to slave cylinder 120 through supply line 130. Wellhead slave cylinder and piston assembly 118 is directly responsive to the working fluid flow to reciprocate the sucker rod at the same rate as the working fluid flow.

Supply assembly 140 has a master drive assembly frame 146. Master drive assembly frame 146 is shown in FIGS. 3 and 4 as a mobile or portable trailer assembly. Other types of frames are of course possible, including stationary frames.

Supply assembly 140 includes a crank assembly connected to frame 146. The crank assembly includes crank arm 144. Each crank arm 144 is rotatably connected to frame 146 by a crank drive which rotates crank arm 144 at a constant rotational speed. More specifically, each crank arm 144 is driven by a crankshaft or drive shaft 149 of a gearbox or reducer 150. A motor 152 is connected to drive gearbox 150 by a belt 154 or by other suitable means. Crank arm 144, gearbox 150, and motor 152 are conventional devices such as available for use in existing mechanical pump jack drives. Motor 152 can be an electric motor, a gasoline or diesel engine, or a hydraulically-powered motor. A hydraulically-driven motor might be desirable, for example, to provide variable speed capability to the drive system.

Supply assembly 140 includes one or more master cylinder assemblies 142. Each of the master cylinder assemblies 142 is pivotally mounted at one of its ends to frame 146 and is driven at its other end by an eccentric crank or crank arm 144. While two master cylinder assemblies 142 are shown, only one is required. Each master cylinder assembly 142 has a pivotal connection 143 at its first end which is pivotally mounted to an anchor bearing assembly 148 on frame 146. The second end of each master cylinder assembly 142 has a similar pivotable connection 145 which is connected to a crank pin 147 on the outward end of its associated crank arm 144.

The crank assembly includes means for adjusting the throw of crank pin 147 and to thereby adjust the stroke lengths of the master cylinder assemblies and, correspondingly, the oil well sucker rod stroke length. Such means will be described in more detail below with reference to FIGS. 15 through 17.

Each master cylinder assembly 142 includes a master hydraulic cylinder 156 and a master piston 158. Master cylinder 156 has first and second axial end sections 160 and 162, corresponding to a first, pressure end of cylinder 156 and a second, working end of cylinder 156. Each of sections 160 and 162 comprises a tubular sleeve which is closed on one end and open on the other. Pivotal connection 143 is formed as part of first axial end section 160. The end sections 160 and 162 are connected together by flanges at their open ends, to form a cylindrical compartment within which master piston 158 reciprocates. A center seal or center seal assembly 168 is positioned at the abutment of the two end sections near the axial midpoint of master cylinder 156. Master piston 158 is slidably received through center seal assembly 168 for axial displacement or reciprocation between the closed ends of first and second end sections 160 and 162. Center seal 168 seals against master piston 158, defining with master piston 158 a working chamber 170 in the working end of master cylinder 156 and a pressure chamber 172 in the pressure end of master cylinder 156. Hydraulic oil or fluid is contained within working chamber 170 and pressure chamber 172.

A piston drive rod 164 is rigidly and non-pivotally connected to master piston 158. It extends axially from master cylinder 156 through a sealing aperture in the closed end of second end section 162. Drive rod 164 is guided by the sealing aperture, being maintained in axial alignment with the master cylinder and master piston. Crank pin 147 of crank arm 144 is pivotally connected to pivotal connection 145 at the end of drive rod 164 to reciprocate master piston 158 within master cylinder 156.

Each of working and pressure chambers 170 and 172 defines a fluid volume which varies with the axial displacement of master piston 158 within master cylinder 156. Working chamber 170 is in fluid communication with wellhead hydraulic cylinder assembly 111 through supply line 130. A hydraulic cooling chamber 174 in supply line 130 cools hydraulic oil passing therethrough. Cooling chamber 174 is optional, and will not be used in many cases.

Supply assembly 140 is in closed communication with wellhead hydraulic cylinder assembly 111 to form a closed hydraulic system, i.e., the working fluid in the system is continuously returned and reused. The closed hydraulic system contains a volume of working fluid which remains fixed and constant except for leakage and corresponding replenishment. Thus, the vertical position of the oil well sucker rod varies directly with the position of master piston 158 within master cylinder 156. The upper and lower extremes of sucker rod displacement are determined by the volume of working fluid contained within the closed hydraulic system. The upper and lower extremes can be adjusted by varying the volume of working fluid within the closed hydraulic system.

The closed hydraulic system between supply assembly 140 and wellhead assembly 111 preferably does not contain a pressure accumulator or any accumulator-like element. The presence of an accumulator would add undesired elasticity to the drive system. Because of the closed communication between working chamber 170 and slave cylinder 120, the vertical position of slave piston 122 relates directly to the axial position of master piston 158 within master cylinder 156.

Crankshaft 149 and crank arm 144 are driven by motor 152 at a constant rotational speed. The rotational motion of crankshaft 149 is translated into axial and reciprocal motion of master piston 158 by the pivotal connection of crank pin 147 to piston drive rod 164. This method of driving master piston 158 results in an approximately sinusoidal rate of master piston displacement. Displacement of master piston 158 causes a corresponding displacement of hydraulic fluid into or out from working chamber 170, which results in a bi-directional working flow of hydraulic fluid through supply line 130. The rate and direction of the working fluid flow is related directly to the rate and direction of master piston displacement. Accordingly, the working fluid flow is bi-directional, alternating between a positive fluid flow from working chamber 170 and a negative fluid flow back into working chamber 170. Wellhead slave cylinder and piston assembly 118 is directly responsive to the master piston reciprocation, by virtue of the working fluid flow caused by such reciprocation, to alternately displace the sucker rod in opposite directions.

In addition to the components described above, supply assembly 140 includes pressure accumulator means for applying upward biasing force to the sucker rod to assist in producing upward displacement of the sucker rod. The accumulator means preferably comprises a gas accumulator 176 which is in fluid communication with pressure chamber 172 of master cylinder 156 through a pressure fluid line 178. Gas accumulator 176 is connected outside of the closed hydraulic system. Pressure chamber 172 and gas accumulator 176 contain a volume of hydraulic oil 180. The volume of hydraulic oil within pressure chamber 172 varies with the axial position of master piston 158. As master piston 158 moves toward the pressure end of master cylinder 156, it displaces oil from pressure chamber 172, out through pressure fluid line 178, and into accumulator 176. Oil is drawn back into pressure chamber 172 as master piston 158 moves toward the working end of master cylinder 156. Accumulator 176 contains an excess of hydraulic oil over that required by pressure chamber 172, so that a minimum level of oil is always present in accumulator 176. A volume of pressurized gas 182 such as nitrogen is also contained within gas accumulator 176 over hydraulic oil 180. The pressure of gas 182 is adjusted through an air valve 183 on top of accumulator 176. Hydraulic oil displacement from pressure chamber 172 and into accumulator 176 is opposed by the gas within accumulator 176. The pressurized gas subsequently assists in displacement of the master piston toward the master cylinder working end.

The portion of the master piston stroke corresponding to the downward stroke of wellhead piston 122, during which little force is required to move the sucker rod, is opposed by the pressurized gas within accumulator 176. During the subsequent upward stroke of wellhead piston 122, during which maximum force must be produced, the compressed gas acts through hydraulic oil 180 to assist in moving master piston 158 toward the working end of master cylinder 156, effectively biasing the sucker rod upward and assisting in producing its upward displacement.

Accumulator pressure increases as the master piston moves toward the master cylinder pressure end, corresponding to downward movement of the sucker rod. Accumulator pressure decreases as the master piston moves toward the master cylinder working end, corresponding to upward movement of the sucker rod. The effect is greatest at the extremes of master piston displacement. However, the crank drive has a mechanical advantage at displacement extremes, essentially producing greater driving force near the ends of the sucker rod strokes. The greater driving force at displacement extremes overcomes and largely negates the variable pressure supplied by the pressure accumulator.

The unique combination of hydraulic and mechanical elements described above drives an oil well sucker rod at a rate which emulates the motion of a conventional mechanical pump jack. In addition, a hydraulic equivalent to a conventional counterweight system is provided by the gas accumulator working against the master piston. The wellhead hydraulic assembly and the master hydraulic cylinder working chamber form a closed hydraulic system which requires no valving and which allows no elasticity other than that produced by the sucker rod itself. Modulating the rate of the working fluid flow to the wellhead hydraulic cylinder is accomplished entirely by the natural reciprocation of the master piston, resulting from its connection to the eccentric crank drive.

The unique mounting of the master cylinder assembly eliminates any offset or misaligned angular forces at the master piston and its drive rod. The pivotal connections allow the master cylinder assembly to pivot angularly in relation to the drive assembly frame during reciprocation of the master piston relative to the master cylinder. All forces are thus aligned with the longitudinal axes of the master cylinder and piston. In conjunction with the use of a displacement piston, with seals fixed to the cylinder rather than to the piston, the pivotal mounting of the master cylinder assembly dramatically reduces the wear on seal and bearing surfaces.

All rods in the preferred embodiments described, such as master piston drive rods and the slave pistons themselves, are preferably chrome-plated. Even more preferably, the rods are "NITROBAR" rods, available from Nitro-Bar Inc., of Pleasant Prairie, Wis.

The system is dramatically simpler than prior art hydraulic drive systems. While some of the additional mechanisms to be described below include valves and valve control mechanisms, such valves do not cycle with each sucker rod reciprocation and are not required to produce such sucker rod reciprocation. Rather, such valves and valve controls are necessary only for replenishing oil supplies or for correcting overstroke conditions. Even with the additional mechanisms to be described, the drive system is much simpler than previous hydraulic drive systems.

Drive system 100 includes overstroke correction means, preferably comprising a hydraulic fluid injector for preventing excessive downward displacement of the sucker rod. Such excessive downward displacement would typically occur because of insufficient oil volume forming the working fluid flow, caused by leakage of hydraulic oil from master cylinder 156 or wellhead cylinder 120. The overstroke correction means functions by sensing excessive downward sucker rod displacement, beyond the predetermined lower limit, and by injecting additional working fluid into the volume contained by the closed hydraulic system to raise the lower extreme of sucker rod displacement.

In actual operation, very little working fluid leakage takes place. Furthermore, it has been found that increasing temperatures during daytime hours causes enough expansion in hydraulic oil to make up for most leakage. In fact, it may be necessary to provide an automatically-actuated valve for bleeding hydraulic oil during ambient temperature rises. During nighttime cooling, however, the system will often require additional hydraulic oil.

The overstroke correction means or fluid injector is positioned to be actuated by downward displacement of the sucker rod beyond a lower limit. Upon actuation, the fluid injector injects additional working fluid into the volume contained by the closed hydraulic system to raise the lower extreme of sucker rod displacement. The overstroke correction means is formed by an injector subsystem 186 and a mechanically-actuated and normally closed two-way fluid line valve 188. Oil injection subsystem 186 supplies pressurized hydraulic oil through an injection supply line 190 to oil line valve 188. Oil line valve 188 is connected, in turn, to selectively supply pressurized hydraulic oil to wellhead cylinder 120.

A valve actuating finger 192 is attached to wellhead piston rod 132 for reciprocal motion corresponding to the reciprocal motion of the oil well sucker rod. Finger 192 and two-way valve 188 are adjustably positioned relative to each other so that finger 192 actuates or enables two-way valve 188 upon downward overstroke, beyond a lower limit, of piston rod 132 and the oil well sucker rod. Upon being enabled, valve 188 injects pressurized hydraulic fluid into the wellhead cylinder 120. The additional oil injected into the working fluid flow raises the operating level of wellhead piston 122, thereby preventing further overstroking in the downward direction.

A guide finger 194 extends laterally behind actuating finger 192. Guide finger 194 is received along a vertically-extending guide bar 196. Guide bar 196 prevents rotation of actuating finger 192 around wellhead piston rod 132 and ensures continued alignment of actuating finger 192 with two-way valve 188.

Oil injection subsystem 186 comprises a hydraulic fluid reservoir 200, a fixed displacement hydraulic pump 202, a nitrogen-charged hydraulic accumulator 204, a hydraulic pressure unloading valve 206, and a closed-center, three-way manual directional control valve 208. Hydraulic pump 202 is connected through a one-way check valve 210 to supply a low volume of high-pressure hydraulic fluid from reservoir 200 to injection supply line 190. Accumulator 204 is connected to injection supply line 190 to level pressure fluctuations. Unloading valve 206 is also connected to supply line 190 to regulate the pressure in supply line 190.

Three-way valve 208 is connected to manually increase or decrease the volume of hydraulic oil in the working fluid flow. Valve 208 is used primarily during initial set-up of the drive system to set the desired range of travel of wellhead piston 122. Initial set-up begins by opening air bleed valve 131 and opening three-way valve 208 to inject oil into the working fluid flow. Air bleed valve 131 is closed when it begins to pass hydraulic oil rather than air. Three-way valve 208 remains open to inject the estimated appropriate volume of hydraulic oil into the working fluid flow. Motor 152 is then energized to begin reciprocation of the master piston. Three-way valve 208 is subsequently used to add or subtract oil from the working fluid flow as required to obtain the desired travel of wellhead piston 122. During normal operation, leakage from the working fluid flow is restored by operation of valve 188. In addition, the nitrogen pressure within accumulator 176 is adjusted through air valve 183 to obtain the desired counterbalancing force as required to adequately oppose the downward stroke of the oil well sucker rod and to assist in its subsequent upward stroke. The accumulator pressure is calculated and adjusted to subject motor 152 to an approximately equal load during both the upstroke and downstroke of wellhead piston 122.

The overstroke correction means could alternately comprise a selectively activated and electrically powered hydraulic pump connected through a one-way check valve to the working fluid flow. The pump could be switched on by an electrical limit switch activated by actuating finger 192. Flow of pressurized hydraulic fluid into the working fluid flow could likewise be initiated by an electrical limit switch connected to open an electrically activated solenoid valve.

Figure 6:
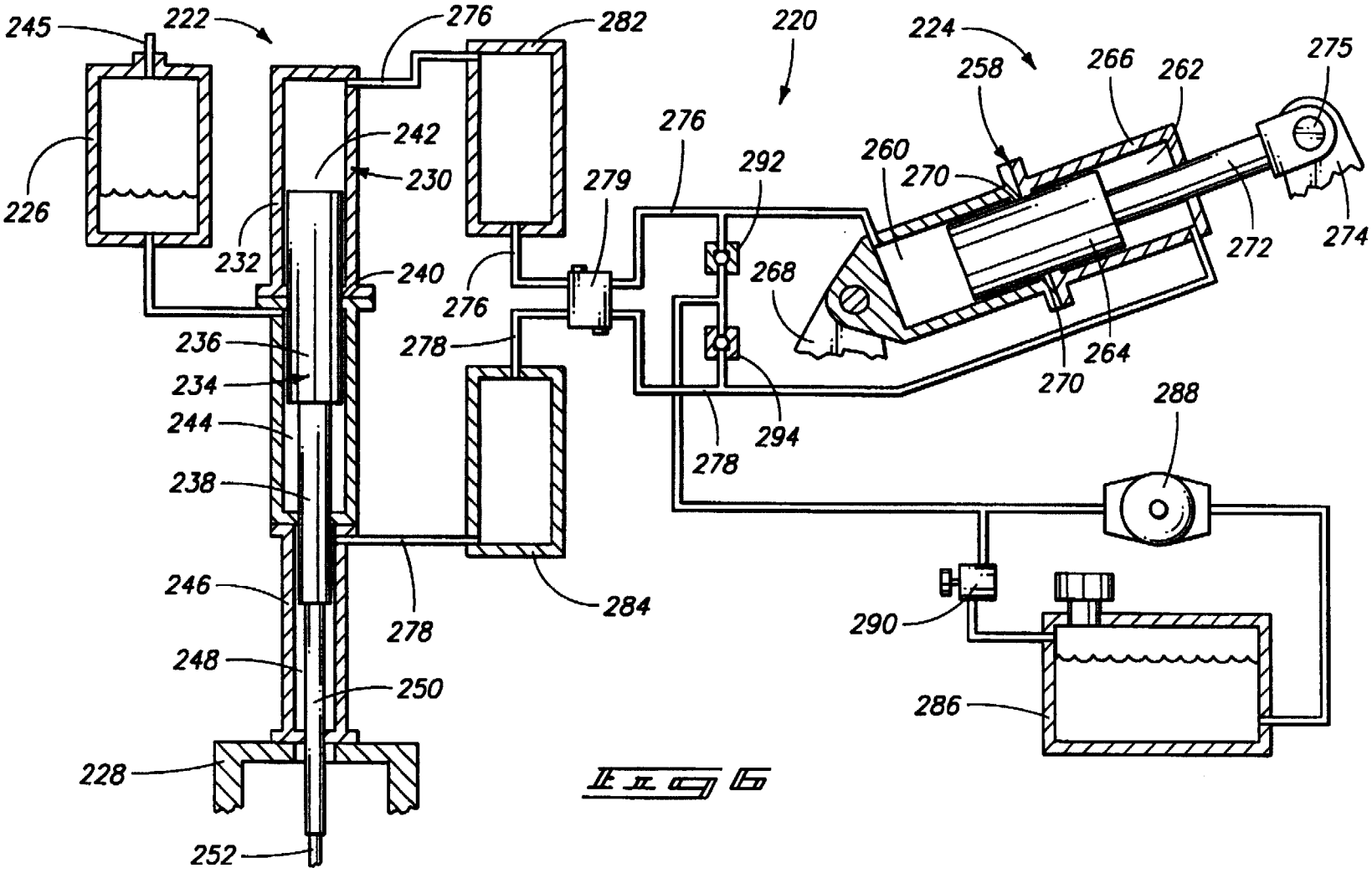
FIG. 6 is a schematic view of a hydraulic oil well pump drive system in accordance with a second preferred embodiment of the invention.

FIG. 6 illustrates a second preferred embodiment of a pump drive system in accordance with the invention, generally indicated by the reference numeral 220. The components shown are similar to those already described above with reference to FIGS. 3–5. Drive system 220 thus includes a wellhead or slave hydraulic assembly 222 driven by a master hydraulic source assembly 224. It also includes a gas accumulator 226 which supplies an upward bias to the oil well sucker rod to assist in upward strokes of the sucker rod. However, gas accumulator 226 operates directly on wellhead hydraulic assembly 222 rather than on master hydraulic source 224.

Wellhead hydraulic assembly 222 includes a fixed vertical wellhead frame 228 which is mounted to a concrete base over a wellhead to drive an oil well sucker rod. Wellhead hydraulic assembly 222 comprises a wellhead slave cylinder and piston assembly 230 having a two-stage wellhead slave piston 234 positioned within an upper primary wellhead slave cylinder 232 and a lower, secondary wellhead slave cylinder 246 for vertical displacement therein. Slave piston 234 includes an upper, primary section 236 and a lower, secondary section 238. Upper section 236 and lower section 238 are aligned concentrically about a vertical axis. Lower section 238 has a smaller diameter than upper section 236, and extends downwardly from upper section 236.

Upper section 236 of slave piston 234 is driven by a working hydraulic fluid flow to reciprocate vertically within upper slave cylinder 232. A seal 240 extends about upper slave cylinder 232 at an approximate midpoint of upper cylinder 232. Upper section 236 of slave piston 234 is slidably received within seal 240, dividing slave cylinder 232 into an upper, working chamber 242 and a lower, pressure chamber 244 at the upper and lower ends of slave cylinder 232, respectively.

Lower section 238 of slave piston 234 extends downward from primary cylinder 232 into secondary slave cylinder 246. Secondary slave cylinder 246 defines a lower working chamber 248. A slave piston rod 250 is connected to a polished rod (not shown) by a connector link 252. Wellhead piston 234 is thus operably connected between wellhead frame 228 and the oil well sucker rod to alternately reciprocate the sucker rod.

Master hydraulic supply assembly 224 comprises a master cylinder assembly or hydraulic source 258 having first and second working chambers 260 and 262. A master piston 264 is positioned within master cylinder assembly 258 for sinusoidal reciprocation. Such reciprocation produces two separate flows of working fluid which are communicated to the upper and lower working chambers of wellhead cylinder assembly 230, respectively. Each of the working fluid flows is isolated from the other. Each working fluid flow has a bi-directional and approximately sinusoidal flow rate resulting from the displacement of master piston 264 within master cylinder assembly 258. However, the working fluid flow rates are generally opposite to each other at any moment.

Master cylinder assembly 258 includes a master hydraulic cylinder 266. Cylinder 266 has a pivotal connection at one of its ends which is mounted to an anchor bearing assembly 268. A center seal or center seal assembly 270 is positioned at an approximate axial midpoint of master cylinder 266. Master piston 264 is positioned within master cylinder 266, being slidably received through center seal assembly 270 for axial displacement or reciprocation between the two axial ends of master hydraulic cylinder 266. Center seal 270 seals against master piston 264, defining with the master piston the first and second working chambers 260 and 262 in the two ends of master cylinder 266. Hydraulic oil or fluid is contained within the two working chambers.

Master piston 264 has a piston drive rod 272 which extends through a sealed aperture and bearing surface in the end of master cylinder 266 opposite its pivotal mounting connection. An eccentric crank arm 274 is pivotally connected to piston drive rod 272 at its crank pin 275. Crank arm 274 is part of a crank assembly as described above. It is driven at a constant speed to reciprocate master piston 264 within master cylinder 266. The displacement of master piston 264 causes a corresponding displacement of hydraulic fluid alternately into and out from working chambers 260 and 262, resulting in bi-directional and approximately sinusoidal working fluid flows from master cylinder assembly 258.

First master working chamber 260 communicates with upper slave working chamber 242 through a fluid supply line 276. Second master working chamber 262 communicates with lower slave working chamber 248 through a similar fluid supply line 278. A cross-over relief valve 279 is connected between supply lines 276 and 278 to relieve excessive levels of hydraulic pressure. Cooling chambers 282 and 284 are also connected in series with supply lines 276 and 278 to cool hydraulic oil passing therethrough.

The two working chambers of master cylinder assembly 258 are thus coupled directly to the two working chambers of wellhead hydraulic assembly 222. Slave piston 234 is directly responsive, through communication of the working fluids through supply lines 276 and 278, to the reciprocal motion of master piston 264 within master cylinder assembly 258. Drive system 220 therefore produces an approximately sinusoidal reciprocation of the oil well sucker rod in emulation of a mechanical pump drive system. The wellhead hydraulic assembly and master hydraulic cylinder working chambers form closed hydraulic systems, which preferably do not include accumulators in order to avoid adding elasticity to the drive system. Because of the direct and closed communication between working chambers 260 and 262 and slave cylinder working chambers 242 and 248, the vertical displacement or position of slave piston 234 relates directly to the axial displacement or position of master piston 264 within master cylinder 266. The extremes of sucker rod displacement are directly related to the amount of working fluid contained within the system.

Gas accumulator 226 is connected for fluid communication with slave pressure chamber 244, forming an accumulator means for applying upward biasing force to the sucker rod. Downward displacement of slave piston 236 displaces hydraulic oil from pressure chamber 244 and into gas accumulator 226. A volume of compressed gas such as nitrogen is contained within gas accumulator 226 to supply a biasing pressure on hydraulic oil in pressure chamber 244 and a corresponding upward biasing force on slave piston 234. The pressure of the compressed gas within accumulator 226 is adjusted through a gas valve 245 to provide appropriate or desired counterbalancing of the oil well sucker rod.

Drive system 220 also includes fluid injection means, comprising a hydraulic fluid reservoir 286, a fixed displacement hydraulic pump 288, and a relief valve 290 for regulating the minimum pressure of hydraulic fluid supplied by hydraulic pump 288. Hydraulic pump 288 supplies pressurized hydraulic fluid to supply lines 276 and 278 through one-way check valves 292 and 294, respectively. Hydraulic pump 288 and relief valve 290 define and maintain a minimum pressure in each of working chambers 260 and 262. An effect of this pressure maintenance is to replenish oil which leaks from the various working chambers and fluid conduits.

Drive system 220 provides a simple hydraulic oil well drive which emulates the motion of a conventional mechanical pump jack. It also provides a counter-pressure system which is the functional equivalent of conventional pump jack counterweights. Because of the closed working fluid communication system, there are no valves or variable restrictions required to modulate the hydraulic fluid flow. The master cylinder mounting provides aligned forces to drive the master piston. The system is much simpler and reliable than prior art hydraulic drives.

FIG. 7 illustrates a third embodiment of an oil well pump drive system in accordance with the invention, generally designated by the reference numeral 300. Again, the system is similar in many respects to the embodiments already described. Drive system 300 is located over a conventional oil wellhead 302. Wellhead 302 has a stuffing box 304 which slidably receives a polished rod 306. Polished rod 306 oscillates or reciprocates in a vertical direction, extending downward through a well casing and production tubing to a sucker rod. The sucker rod extends through the well casing and production tubing to a plunger at the bottom of the oil well. The plunger is driven by the sucker rod to lift oil to the surface and to pump said oil through a production line.

A wellhead hydraulic assembly 311 is mounted directly over wellhead 302 to drive the oil well sucker rod. A fixed vertical wellhead frame 312 connects wellhead hydraulic assembly 311 to wellhead 302. Wellhead hydraulic assembly 311 includes a wellhead slave cylinder and piston assembly 318 having a wellhead slave cylinder 320 and a reciprocating wellhead slave piston 322. It receives a working fluid flow through a hydraulic supply line 330. The working fluid flow is bi-directional, alternating in direction between positive, inward flow to cylinder assembly 320 and negative, outward flow from cylinder 320. The bi-directional working fluid flow produces relative reciprocal motion between the wellhead piston and cylinder. Positive flow of hydraulic fluid to wellhead slave cylinder and piston assembly 318 through supply line 330 raises polished rod 306 at a rate which is directly proportional to the rate of positive fluid flow. Negative flow of hydraulic fluid from wellhead slave cylinder and piston assembly 318 through supply line 330 lowers polished rod 306 at a rate proportional to the rate of negative fluid flow. Further details regarding preferred designs of wellhead cylinder assemblies will be described in more detail below.

Drive system 300 includes a master hydraulic source or supply assembly 340 for driving wellhead hydraulic assembly 311. Supply assembly 340 is in fluid communication with wellhead hydraulic assembly 311, supplying a working fluid flow through supply line 330. Supply assembly 340 is of a type which produces an alternating bidirectional flow of working fluid to and from wellhead assembly 311 to reciprocally displace the oil well sucker rod between upper and lower extremes. Wellhead hydraulic assembly 311 is directly responsive to the working fluid flow to reciprocate the sucker rod at the same rate as the working fluid flow.

Supply assembly 340 has a master drive assembly frame 346. A master cylinder assembly 342 has a pivotal connection 343 which is pivotally mounted or connected to frame 346. It has another end which is pivotally connected to and driven by an eccentric crank or crank arm 344 by a pivotal connection 345.

Supply assembly 340 includes a crank assembly connected to frame 346. The crank assembly includes crank arm 344. Crank arm 344 is rotatably connected to frame 346 by a crank drive mechanism which rotates crank arm 344 at a constant rotational speed. More specifically, crank arm 344 is driven by a drive shaft or crankshaft 349 of a gear box or reducer 350. A motor 352 is connected to drive gear box 350 by a belt 354 or other suitable means.

The crank assembly includes means for adjusting the offset of crank pin 347 from crankshaft 349, and to thereby adjust the stroke lengths of the master cylinder assembly and, correspondingly, the oil well sucker rod. These features will be described in more detail below with reference to FIGS. 15–17.

Master cylinder assembly 342 includes a master hydraulic cylinder 356 and a master piston 358. Master cylinder 356 has first and second axial end sections 360 and 362, corresponding to a first, pressure end of cylinder 356 and a second, working end of cylinder 356, respectively. Each of second sections 360 and 362 comprises a tubular sleeve which is closed on one end and open on the other. The two sections are connected together with their open ends towards each other to form a cylindrical compartment within which master piston 358 reciprocates.

Figure 8:
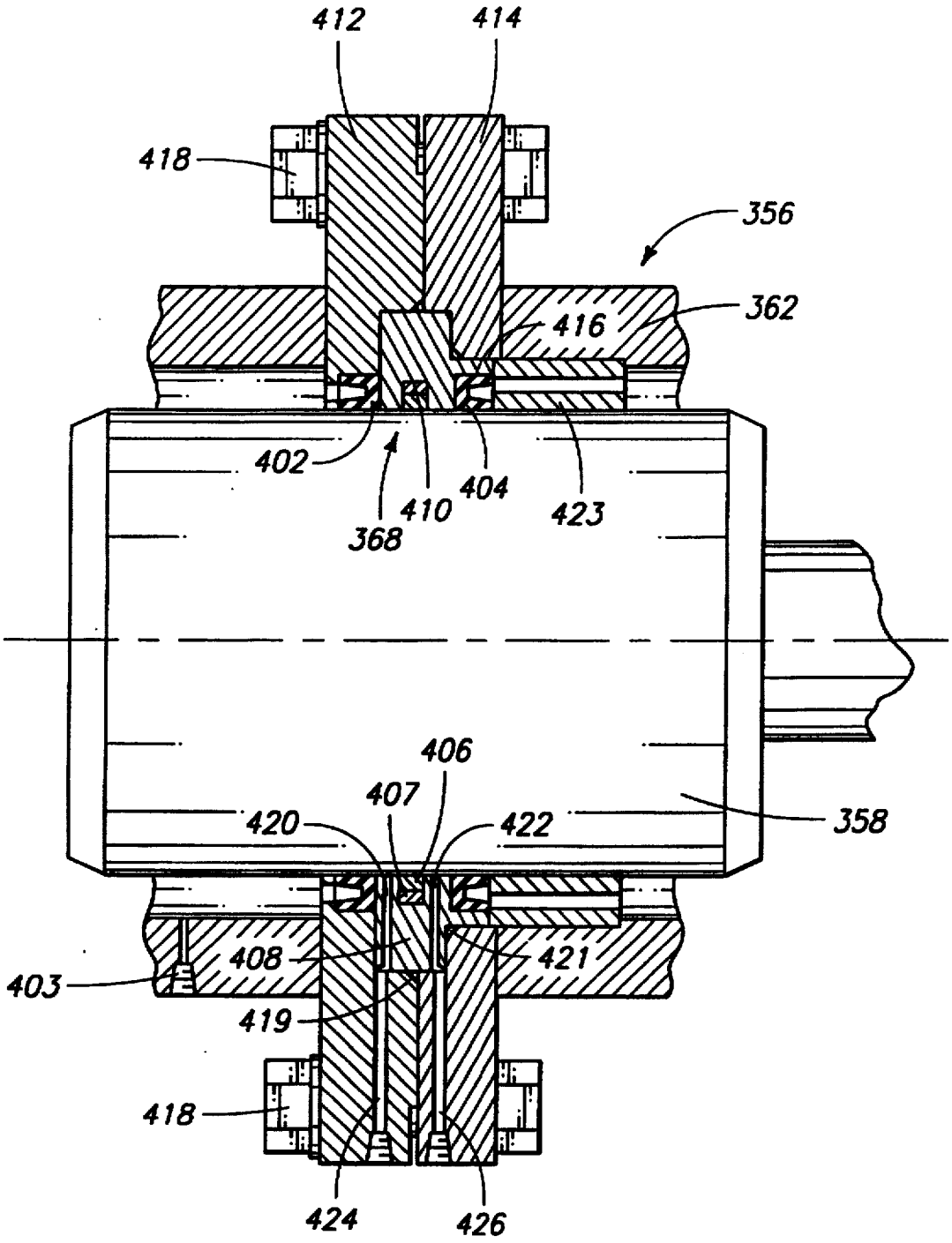
FIG. 8 is a partial cross-sectional view of a master hydraulic cylinder and piston in accordance with a preferred embodiment of the invention.

FIG. 8 shows a center seal or a center seal assembly 368 which is mounted within master cylinder 356 at a fixed axial position. Center seal assembly 368 is positioned at the abutment of the two end sections at an approximate axial midpoint of master cylinder 356. Center seal assembly 368 divides master cylinder 356 into a working chamber 370 and a pressure chamber 372. Master piston 358 is slidably received through center seal assembly 368.

Center seal assembly 368 comprises a pressure end hydraulic seal 402 and a working end hydraulic seal 404. Pressure end and working end hydraulic seals 402 and 404 are "Variseal M" or "Varipak M" seals made of glass-filled Teflon™ impregnated with molybdenum disulfide. Such seals are Variseal Corp. of Broomfield, Colo. Seals such as these are capable of operating dry and over a wide range of temperatures. In addition, they are spring-loaded to prevent weepage at low pressures. Because of these advantages, all hydraulic seals in the preferred embodiments described herein are "Variseal M" or "Varipak M" seals.

Hydraulic seals 402 and 404 are axially spaced from each other, with working end hydraulic seal 404 being spaced toward the master cylinder working end from pressure end hydraulic seal 402. Pressure end hydraulic seal 402 restricts hydraulic fluid passage from pressure chamber 372 of the master cylinder. Working end hydraulic seal 404 restricts hydraulic fluid passage from the working chamber 370 of master cylinder 356.

A dividing seal surrounds master piston 358 between pressure end hydraulic seal 402 and working end hydraulic seal 404. The dividing seal comprises an inner ring 406 of Teflon™ surrounded by a Neoprene loader 407. The inner Teflon™ ring surrounds and receives master piston 358, being urged into sliding engagement with master piston 358 by loader 407. The dividing seal defines a pressure end seal gap between the dividing seal and pressure end hydraulic seal 402. It also defines a working end seal gap between the dividing seal and working end hydraulic seal 404.

More specifically, center seal assembly 368 includes a steel seal retaining ring 408 with inner periphery approximately complementary in diameter to the outer periphery of master piston 358. Center seal assembly 368 slidably receives the master piston while providing a hydraulic seal separating working chamber 370 and pressure chamber 372. Seal retaining ring has an annular groove 410 which extends completely about its inner periphery. The dividing seal is received within annular groove 410 to surround master piston 358. Pressure end hydraulic seal 402 and working end hydraulic seal 404 are spaced axially from opposite sides of the dividing seal adjacent opposite sides of seal retaining ring 408.

Pressure end section 360 of cylinder 356 includes a radially-extending pressure end flange 412 about its open end. Working end section 362 includes a radially-extending working end flange 414 about its open end. Pressure end flange 412 has an inner surface with an annular groove extending thereabout for receiving pressure end hydraulic seal 402. Seal retaining ring 408 abuts flange 412, retaining pressure end hydraulic seal 402 within the annular groove. Apertures are positioned to allow fluid communication between pressure chamber 372 and the cup of pressure end hydraulic seal 402. Working end hydraulic seal 404 is received within an annular slot 416 formed about seal retaining ring 408. Working end flange 414 abuts seal retaining ring 408 to retain seal retaining ring 408 between flanges 412 and 414. Bolts 418 extend through flanges 412 and 414 about the periphery of master cylinder assembly 342 to secure the two end sections 360 and 362 to each other. An O-ring 419 is received between flanges 412 and 414. An O-ring 421 is received between flange 414 and retaining ring 408.

An annular bronze bearing 423 surrounds master piston 358, providing a bearing surface against master piston 358. Bronze bearing 423 is received within a relief in the inner wall of cylinder end section 362 at an axial position against seal retaining ring 408. The bearing also abuts working end hydraulic seal 404 to retain it within its annular slot. Apertures are provided in the bronze bearing to communicate pressurized hydraulic oil from working chamber 370 to the cup of working end hydraulic seal 404.

Seal retaining ring 408 has a pair of fluid passages extending outward from its inner periphery to communicate with corresponding passages in cylinder flanges 412 and 414. More specifically, a pressure end fluid passage 420 extends from the pressure end seal gap between the dividing seal and the pressure end hydraulic seal 402. A working end fluid passage 422 extends from the working end seal gap between the dividing seal and working end hydraulic seal 404. Corresponding pressure end and working end flange passages 424 and 426 are 18 formed in flanges 412 and 414 between fluid passages 420 and 422 and the outer periphery of flanges 412 and 414. The fluid passages described above allow hydraulic fluid which escapes or leaks past hydraulic seals 402 and 404 to be collected in respective reservoirs through fluid passages 420 and 422, and through flange passages 424 and 426. In addition, a fluid injection port 403 allows hydraulic fluid to be injected into pressure chamber 372 during device operation.

Referring again to FIG. 7, master piston 358 is positioned within master cylinder 356, and is slidably received through center seal assembly 368 for axial displacement or reciprocation between the closed ends of first and second end sections 360 and 362. Seal 368 and master piston 358 define working chamber 370 in the working end of master cylinder 356 and pressure chamber 372 in the pressure end of master cylinder 356. Hydraulic oil or fluid is contained within working chamber 370 and pressure chamber 372.

Like the embodiments described above, master piston 358 has a rigid and non-pivotally attached piston drive rod 364 which extends through the closed end of working end section 362. It is aligned axially with master cylinder 356 and master piston 358. A crank pin 347 at the outer end of crank arm 344 is pivotally connected to pivotal connection 345 on piston drive rod 364 to reciprocate master piston 358 within master cylinder 356.

Each of the working and pressure chambers 370 and 372 defines a fluid volume which varies with the reciprocation of master piston 358 within master cylinder 356. Working chamber 370 is in fluid communication with wellhead hydraulic assembly 311 through supply line 330 to form a closed hydraulic system. An air bleed valve 451 is optionally positioned at an intermediate position along supply line 330. The closed hydraulic system contains a volume of hydraulic fluid which generally remains fixed and constant. The extremes of sucker rod displacement relate directly to the volume of hydraulic oil contained by the system.

Crankshaft 349 and crank arm 344 are driven by motor 352 and gearbox 350 at a constant rotational speed which is translated into axial and reciprocal motion of master piston 358. Wellhead hydraulic assembly 311 is directly responsive to the working fluid flow caused by the master piston reciprocation to alternately displace the sucker rod in opposite directions at a sinusoidal rate. Because of the closed communication between working chamber 370 and slave cylinder 320, the vertical position of slave piston 322 relates directly to the axial position of master piston 358 within master cylinder 356.

A gas accumulator 376 is connected directly to and above the pressure end of hydraulic cylinder 356, outside of the closed hydraulic system. Accumulator 376 is in fluid communication with pressure chamber 372 of master cylinder 356 through a connecting passage 378. Pressure chamber 372 contains a volume of hydraulic oil which varies with the axial position of master piston 358. As master piston 358 moves toward the pressure end of master cylinder 356, it displaces oil from pressure chamber 372 and into gas accumulator 376. Hydraulic oil is drawn back into pressure chamber 372 as master piston 358 moves toward the working end of master cylinder 356. Accumulator 376 contains an excess of hydraulic oil so that a minimum level of oil is always present in accumulator 376. A volume of compressed gas such as nitrogen is also contained within gas accumulator 376, over the hydraulic oil. The pressure of the gas is adjusted through an air valve 383 on top of accumulator 376. The compressed gas maintains an equivalent pressure in the hydraulic oil within pressure chamber 372, and a corresponding biasing force on master piston 358 toward the working end of hydraulic cylinder 356. The biasing force assists in displacement of the master piston toward the master cylinder working end, effectively biasing the sucker rod upward.

To monitor and maintain proper fluid levels within pressure chamber 372, gas accumulator 376, and working chamber 370, fluid recovery means are provided for receiving hydraulic fluid which leaks past pressure end hydraulic seal 402 and working end hydraulic seal 404. Specifically, a working end fluid reservoir 440 is in fluid communication with the working end seal gap through flange passage 426 and fluid passage 422 to receive fluid which leaks past working end hydraulic seal 404 from working chamber 370. A pressure end fluid reservoir 442 is likewise in fluid communication with the pressure end seal gap through flange passage 424 and fluid passage 420 to receive hydraulic fluid which leaks past pressure end hydraulic seal 402 from pressure chamber 372. Working end fluid reservoir 440 and pressure end fluid reservoir 442 each have a fluid level indicator, such as a sight window 444. The sight window in pressure end fluid reservoir 442 is useful to indicate the leaked fluid volume received from pressure chamber 372. In addition, manually operated working and pressure end fluid injectors 446 and 448 are connected to receive oil from fluid reservoirs 440 and 442, respectively, and to inject hydraulic oil back into the working fluid flow and into pressure chamber 372. Working end fluid injector 446 is used primarily upon initiating drive system operations, to fill the various working chambers. It is connected through an injection line 450 to inject oil into supply line 330. Pressure end fluid injector 448 is used during operation of the system to restore leaked hydraulic fluid to pressure chamber 372. It is connected through an injection line 452 to inject oil into pressure chamber 372. The sight window in pressure end fluid reservoir 442 allows fluid injection into the appropriate fluid chambers when the leaked fluid volume exceeds a predetermined limit. Alternatively, a float actuator (not shown) could be located within pressure end fluid reservoir 442 to automatically actuate a fluid injector such as an electrically powered pump or a solenoid valve to inject hydraulic fluid into pressure chamber 372.

Manual shut-off valves 454 and 456 are positioned downline of each of fluid injectors 446 and 448 to isolate them from the pressurized hydraulic fluid as desired. In addition, manually operated bypass valves 458 and 460, connected between injection lines 450 and 452 and the hydraulic reservoirs, allow the level of oil in the working fluid flow and in the pressure chamber to be decreased as required. Electrical pressure switches 462 and 464 are located in injection lines 450 and 452 to shut down the system in the case of a drop in hydraulic pressure below a predetermined limit.

In addition to the mechanisms described above, wellhead hydraulic assembly 311 includes a mechanically driven injector pump 472 forming overstroke correction means for preventing excessive downward displacement of the sucker rod beyond a pre-determined limit. As mentioned, the upper and lower extremes of sucker rod displacement are determined primarily by the volume of working fluid contained within the closed hydraulic system. Thus, the extremes of sucker rod displacement can be raised by injecting additional oil into the system. This is accomplished automatically by injector pump 472.

Injector pump 472 is preferably a piston pump which is actuated by depressing a vertically-extending plunger. Wellhead hydraulic assembly 311 includes a push rod 474 which extends upwardly above slave cylinder 320, being slidably received at its upper end by a guide arm 475. The lower end of push rod 474 is aligned with the plunger of injector pump 472. The top of slave piston 322 includes a laterally extending member 477 which reciprocates with polished rod 306. The length of the rod is chosen so that extending member 477 strokes or depresses push rod 474 and injector pump plunger 482 whenever downward polished rod displacement exceeds the predetermined lower limit. Injector pump 472 is connected to receive hydraulic oil from working fluid reservoir 440 and to supply or inject hydraulic oil, when driven by push rod 474, into the working fluid flow. Excessive downward displacement of polished rod 306 is therefore corrected by injection of additional hydraulic oil into the closed working fluid flow system whenever excessive downward movement of polished rod 306 is encountered. This raises the lower extreme of sucker rod displacement. Thus, the mechanism automatically corrects for leakage from the working fluid flow.

Figure 9:
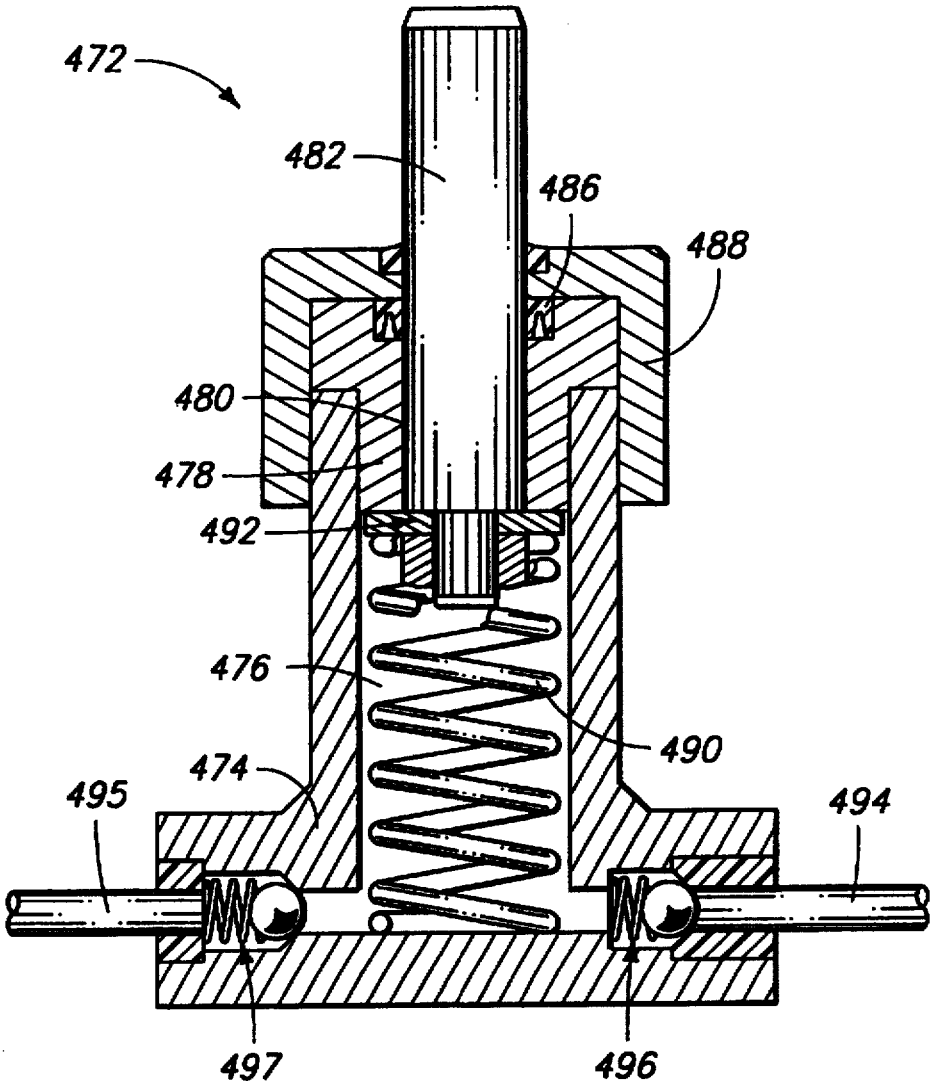
FIG. 9 is a cross-sectional view of a single-action fluid injector pump in accordance with a preferred embodiment of the invention.

FIG. 9 shows an example of a single-action piston injection pump 472. Injection pump 472 includes a base housing 474 with a cylindrical inner chamber 476 containing hydraulic oil. A sleeve bearing 478 fits within inner chamber 476 at its upper end. Sleeve bearing 478 has a central cylindrical inner bore 480 which is concentric with inner chamber 476. A piston 482 extends from inner chamber 476, through sleeve bearing 478, and upward to form a pump plunger.

Inner bore 480 has an inner diameter which is approximately complementary to the outer diameter of piston 482. A hydraulic seal 486 is received about sleeve bearing 478 to surround and seal against piston 482 as it exits base housing 474. A cap 488 retains sleeve bearing 478 within base housing 474. A spring 490 extends from the bottom of inner chamber 476 to urge piston 482 upwardly. Piston 482 is retained within base housing 474 by a washer assembly 492 at the lower end of piston 482.

Inner chamber 476 communicates with working end fluid reservoir 440 through an intake line 494. Pressurized hydraulic fluid is supplied from inner chamber 476 to slave cylinder 320 through a pressure outlet line 495. Check valves 496 and 497 are positioned in series with intake line 494 and outlet line 495, respectively, to ensure that working fluid flow occurs only in the direction from intake line 494 to outlet line 495. Stroking piston 482 downward forces oil out through outlet line 495. Check valve 496 prevents hydraulic fluid from escaping through intake line 494. During the subsequent upstroke of piston 482, outlet check valve 4 97 closes while intake check valve 496 opens to allow hydraulic fluid to enter inner chamber 476 from fluid reservoir 440.

The injection pump described above is merely an example of a mechanically-actuated pump which could be used in combination with a wellhead hydraulic cylinder. Other types of pumps are also possible and may be desirable. A mechanically-actuated injection pump is in many situations superior to valve-actuated or electrically-actuated systems described because of its simplicity.

Figure 10:
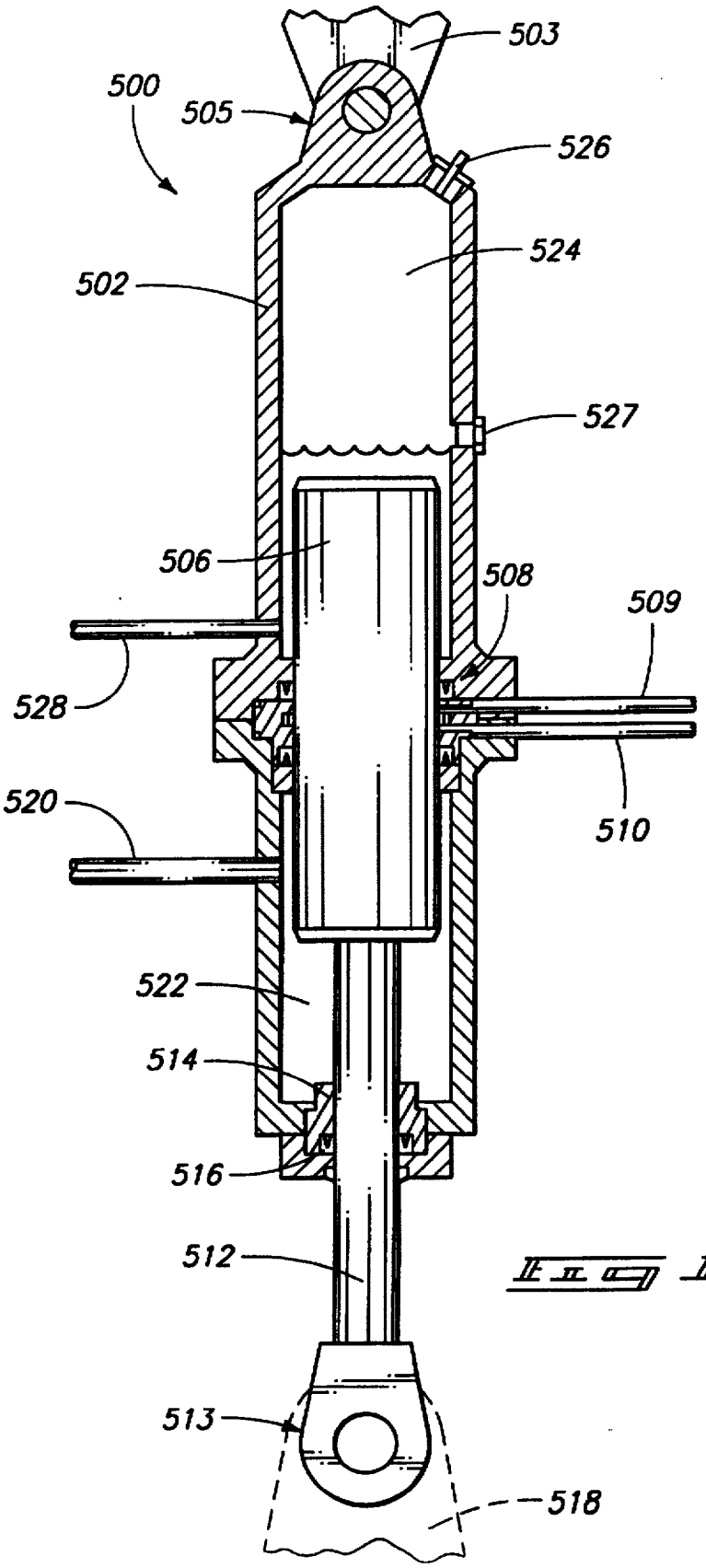
FIG. 10 is a cross-sectional view of a vertically-oriented master hydraulic cylinder and piston in accordance with a preferred embodiment of the invention.
Figure 11:
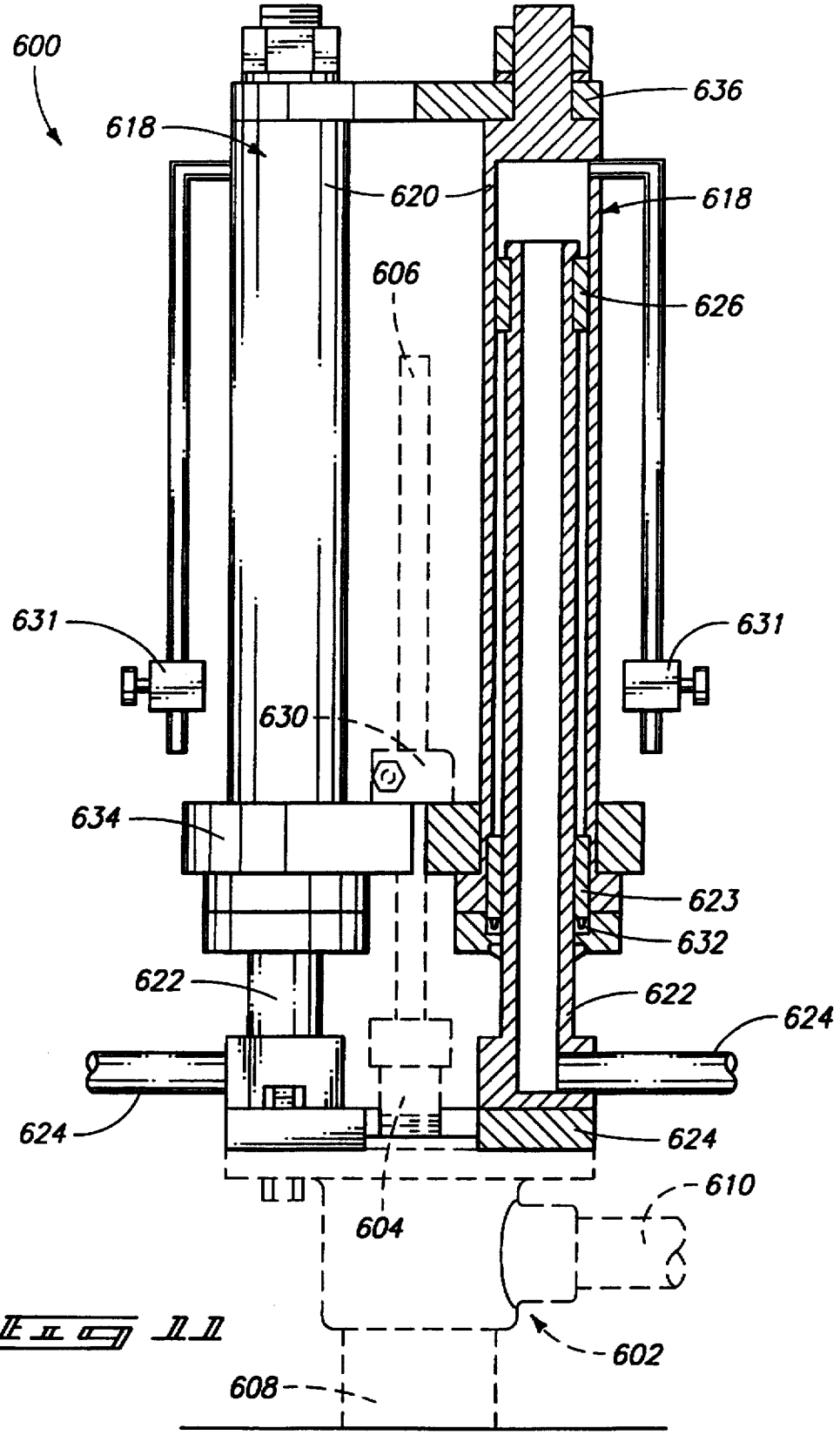

FIG. 10 shows an alternative embodiment of a master cylinder assembly, generally designated by the reference numeral 500. Master cylinder assembly 500 is generally similar to master cylinder assembly 342 described above with reference to FIGS. 7 and 8. However, master cylinder assembly 500 includes a master hydraulic cylinder 502 which is oriented generally vertically, with its pressure end positioned generally above its working end. Rather than communicating with a separate gas chamber, a gas chamber or pressure accumulator is formed within the pressure chamber of master hydraulic cylinder 502. The pressure chamber contains a volume of hydraulic oil, and also a volume of gas above the hydraulic oil. The gas is precharged to an appropriate pressure to bias the master piston toward the working end of cylinder 502.

More specifically, master cylinder assembly 500 has a pivotable connection 505 at its upper end which is mounted to a frame member 503. A master piston 506 is positioned within master cylinder 502 for axial displacement therein. Master piston 506 is surrounded at a midpoint of master cylinder 502 by a center seal assembly 508 such as already described with reference to FIG. 8. Center seal assembly 508 is mounted at a fixed axial position along the inside of master cylinder 502. Master piston 506 has a rigidly and non-pivotally attached piston drive rod 512 which extends downward from master piston 506 and through the lower end of master hydraulic cylinder 502. A sleeve bearing 514 and a hydraulic seal 516 surround piston drive rod 512 at the lower end of cylinder 502, maintaining piston 506 and drive rod 512 in axial alignment with master cylinder 502. Piston drive rod 512 is connected by a pivotable connection 513 at its outer end to an eccentric crank arm 518 which rotates at a constant speed to reciprocate master piston 506 within master hydraulic cylinder 502.

Master piston 506 is slidably received through center seal assembly 508 for axial displacement or reciprocation within master cylinder 502. Center seal assembly 508 seals against master piston 506, defining with master piston 506 a working chamber 522 in the lower end of master cylinder 502 and a pressure chamber 524 in the upper end of master cylinder 502. Working chamber 522 is filled with hydraulic fluid which is communicated to and from a wellhead cylinder assembly through a hydraulic fluid supply line 520. Reciprocal displacement of master piston 506 causes a corresponding displacement of hydraulic fluid through fluid supply line 520. The connected wellhead cylinder assembly responds as already described to reciprocate an oil well sucker rod at an approximately sinusoidal rate.

Pressure chamber 524 contains a small volume of hydraulic oil. The purpose of such hydraulic oil within pressure chamber 524 is to lubricate and insure proper sealing between master piston 506 and the hydraulic seals in the center seal assembly 508. Pressure chamber 524 also contains a pressure-charged gas such as nitrogen. Such gas maintains a downward biasing force against master piston 506, acting as a counterbalance similar to the counterbalance weight of a mechanical pump jack. Pressure chamber 524 is preferably charged through a gas charge valve 526 atop master cylinder 502. The gas pressure within pressure chamber 524 is adjusted to impose an approximately equal load on a driving power source during both upstroke and downstroke of a driven oil well sucker rod. Cylinder 502 also has an oil level check plug 527 for initially filling pressure chamber 524.

Master cylinder assembly 500 includes fluid communication ports for cooperation with a leaked fluid recovery system such as described above. For instance, fluid recover lines 509 and 510 communicate from the center seal assembly seal gaps to appropriate hydraulic fluid reservoirs to recovery any hydraulic fluid which leaks past center seal assembly 508. Fluid injection port 528 communicates with pressure chamber 524 to allow leaked hydraulic fluid to be returned to pressure chamber 524.

Master cylinder assembly 500 has the advantage of being simpler than other embodiments described herein, having an integral compression chamber which does not required an external housing. Moreover, the vertical profile of the resulting hydraulic source may be desirable in some situations. It is also possible to incline cylinder assembly 500 to some degree, as long as sufficient hydraulic oil is present within pressure chamber 524 to surround center seal assembly 508. Prototypes of the invention have been fabricated using an inclined master cylinder orientation. It will also be desirable in some situations to enlarge the compression chamber of the master cylinder relative to the working chamber to minimize the effects of changing pressure within the compression chamber. It is also desirable to minimize the amount of working fluid to reduce the effects of oil expansion and contraction.

Figure 11:
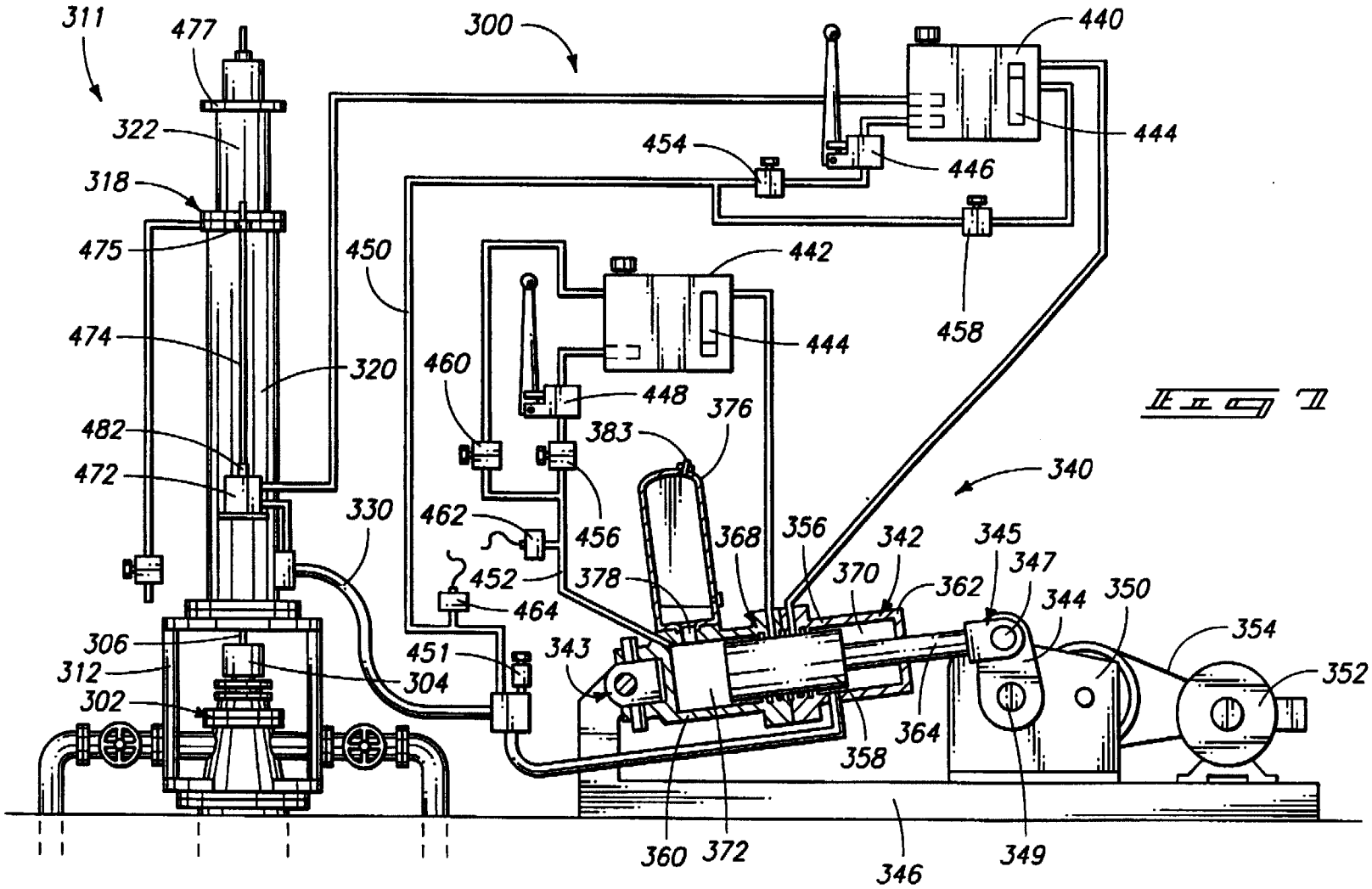
FIG. 11 is a side view of a dual-cylinder wellhead hydraulic cylinder assembly in accordance with a preferred embodiment of the invention, with one of the cylinders being shown in cross-section.

FIG. 11 shows a preferred embodiment dual-cylinder wellhead slave cylinder and piston assembly, generally designated by the reference numeral 600. Wellhead hydraulic assembly 600 is located at conventional oil wellhead 602. Wellhead 602 has a stuffing box assembly 604 which receives a polished rod 606 therethrough. Polished rod 606 oscillates or reciprocates in a vertical direction, extending downward through a well casing 608 to a sucker rod. The sucker rod extends downward through well casing 608 to a plunger at the bottom of the oil well. The plunger is driven by the sucker rod to lift oil to the surface and to pump said oil through a production line 610.

Wellhead hydraulic assembly 600 is mounted to a wellhead flange around the top of well casing 608 to alternately displace the sucker rod in opposite vertical directions. It includes a pair of identical wellhead cylinder and piston assemblies 618 which are laterally spaced from each other about polished rod 606. This arrangement allows a low profile, since the wellhead stuffing box can in many cases be positioned between the hydraulic cylinders.

Each wellhead cylinder and piston assembly 618 has a reciprocating outer cylinder 620 and a stationary slave piston or inner rod 622. In contrast to conventional wellhead hydraulic cylinders, however, cylinder and piston assemblies 618 are inverted. More specifically, wellhead slave rods or pistons 622 are mounted by a base plate 624 directly to wellhead 602. Outer cylinder 620 has an inner diameter which is slightly larger than the outer diameter of stationary inner rod 622, and is slidably received over stationary inner rod 622 to reciprocate vertically in response to a working fluid flow.

Figure 12:
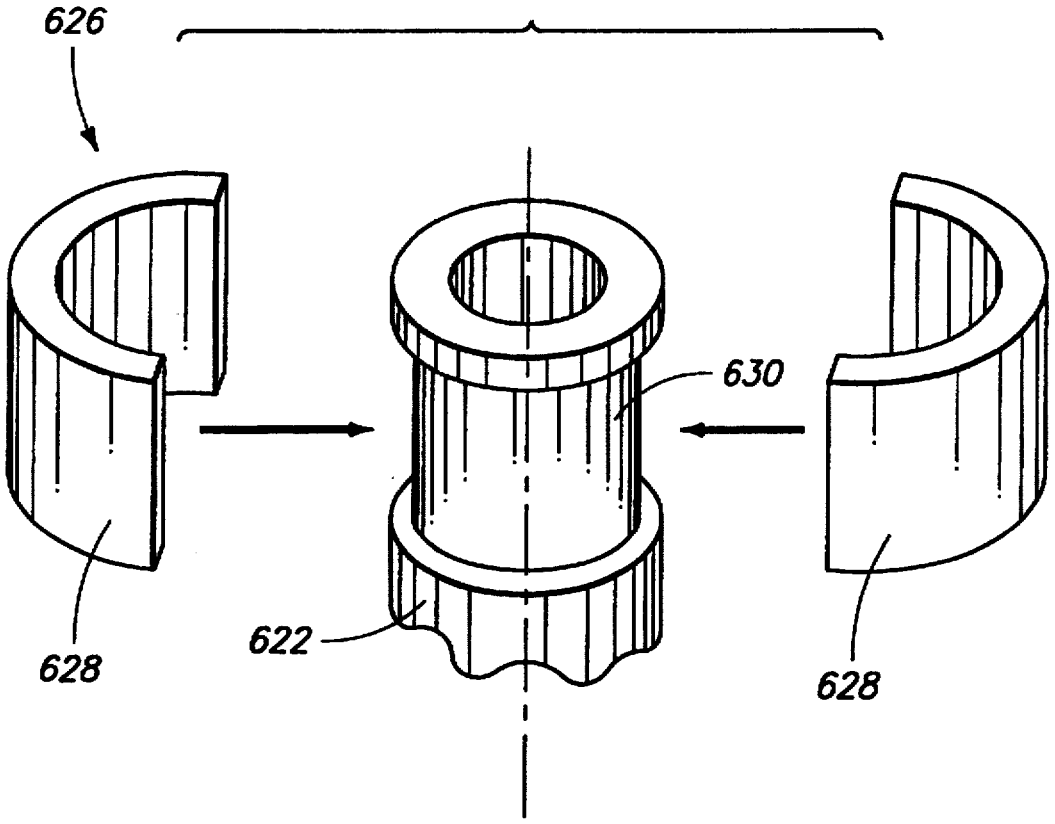
FIG. 12 is an exploded isometric view of a split bearing assembly for a wellhead slave cylinder in accordance with a preferred embodiment of the invention.

A lower sleeve bearing 623 is affixed to the lower end of outer cylinder 620 to provide a sliding inner bearing surface against stationary inner rod 622. An upper split sleeve 626 bearing is also retained by inner rod 622 between its outer surface and the inner surface or wall of outer cylinder 620, as shown in FIG. 12. The bearing has an outer bearing surface that slides relative to the inner wall of the hydraulic cylinder. Split sleeve bearing 626 comprises two semicircular halves 628 which are received about a corresponding relief or circumferential groove 630 formed near the upper end of stationary inner rod 622. This construction allows sleeve bearing 626 to be assembled around relief 630 before outer cylinder 620 is slid over stationary inner rod 622. Once assembled, split sleeve bearing 626 is vertically retained, relative to inner rod 622, by relief 630. The bearing is retained within the relief by the inner wall of outer cylinder 620.

Stationary inner rod 622 has a hollow interior which is connected at its lower end to fluid supply line 624. The upper end of inner rod 622 is open for fluid communication with the interior of outer cylinder 620. The combined interiors of inner rod 622 and outer cylinder 620 form a slave cylinder working chamber having a volume which varies with the vertical displacement of outer cylinder 620 in relation to stationary inner rod 622. A hydraulic seal 632 at the lower end of outer cylinder 620 surrounds and seals against stationary inner rod 622 to prevent escape of hydraulic oil from the slave cylinder working chamber. Because of the inverted construction of the cylinder assembly, only one seal is required for each cylinder. Air bleed valves 631 are connected for fluid communication with the slave cylinder working chamber to allow accumulated gas to be discharged from the working chamber.

Outer cylinders 620 are connected together to reciprocate in unison. A yoke plate 634 extends laterally between cylinders 620 to connect the cylinders together at their lower ends. A tie plate 636 extends similarly between the top ends of cylinders 620. Polished rod 606 is connected to yoke plate 634 midway between the two wellhead cylinder assemblies by a rod clamp 630. The connection of polished rod 606 is at an elevation at or near the lower end of outer cylinders 620. This prevents torsion which might otherwise bind the cylinder assemblies.

The specific construction of the wellhead hydraulic assembly described above provides at least two significant advantages. First, the oil well polished rod is connected between individual hydraulic cylinder assemblies rather than directly in line with a reciprocating member. Second, the polished rod is connected at or near the lower end of the cylinder assembly reciprocating member, rather than at its upper end as has been the case with prior art devices. This prevents binding of the side-by-side hydraulic cylinders.

Figure 13:
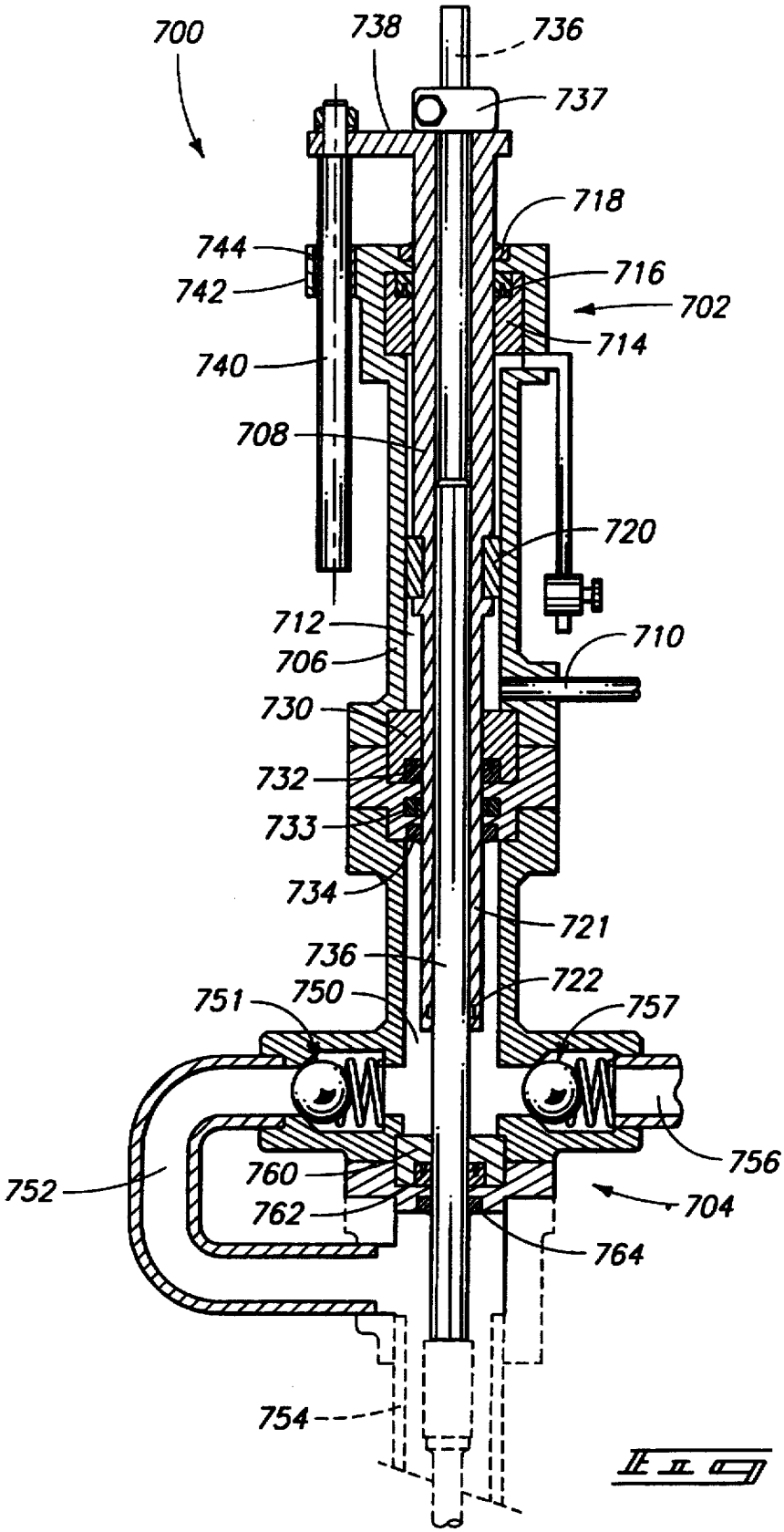
FIG. 13 is a cross-sectional side view of a single-cylinder wellhead hydraulic cylinder assembly and a wellhead transfer pump in accordance with a preferred embodiment of the invention.

FIG. 13 shows another preferred embodiment wellhead hydraulic assembly, generally designated by the reference numeral 700. Wellhead hydraulic assembly 700 includes both a wellhead slave cylinder assembly 702 and a wellhead transfer pump 704 which operates synchronously with cylinder assembly 702.

Wellhead slave cylinder assembly 702 includes a stationarily-mounted slave cylinder 706. A slave piston 708 is positioned therein for vertical reciprocation in response to a bi-directional fluid flow supplied through a fluid supply line 710. Cylinder 706 has a cylindrical interior which forms a slave cylinder working chamber 712. Slave piston 708 extends upward from working chamber 712, through a sleeve bearing 714, a hydraulic seal 716, and a wiper seal 718. A split sleeve bearing 720, such as that described above with reference to FIG. 12, surrounds slave piston 708 within the interior of working chamber 712. Slave piston 708 has a reduced diameter lower portion 721 which extends downward, through a sleeve bearing 730, a hydraulic seal 732, and a wiper seal 734 in the lower end of slave cylinder 706.

A rod arm 738 extends laterally from slave piston 708 above slave cylinder 706. A guide rod or pump actuator rod 740 is adjustably mounted by arm 738 to extend downward alongside the exterior of cylinder 706. A guide arm 742 extends laterally from the upper end of slave cylinder 706, having a guide aperture 744 through which the actuator rod is received. Pump actuator rod 740 is adjusted vertically to depress or otherwise drive an injector pump operator or plunger (not shown) to inject additional hydraulic oil into working chamber 712 upon excessive downward displacement of slave piston 708. Guide arm 742 maintains the desired rotational alignment of slave piston 708, ensuring that actuator rod 740 is aligned over the injector pump plunger.

A polished rod 736 is received through an axial aperture formed in the center of slave piston 708, being connected at the top of slave piston 708 by a polished rod clamp 737. A hydraulic seal 722 seals between the axial aperture in slave piston 708 and the received polished rod 736. Polished rod 736 connects at its lower end to an oil well sucker rod to drive an oil well pump plunger.

Wellhead transfer pump 704 is aligned below wellhead slave cylinder assembly 702, concentric with slave piston 708 and polished rod 736. It has a cylindrical pump chamber 750 which communicates through an inlet check valve 751 and a transfer line 752 with an oil well casing and production tube 754. Pump chamber 750 also communicates with an oil production line 756 through an outlet check valve 757. Inlet check valve 751 allows production oil into pump chamber 750 from the oil well while preventing passage of production oil from pump chamber 750 back into the oil well. Outlet check valve 757 allows production oil to be pumped out of pump chamber 750 and into production line 756, while preventing flow of production oil in the reverse direction, or back into pump chamber 750 from production line 756. The reduced diameter lower section of slave piston 708 forms a pump piston within pump chamber 750 which varies the internal fluid volume of pump chamber 750. Diameter of the slave cylinder reduced section is of necessity slightly larger than the diameter of the oil well plunger so that a slight vacuum is created during the upward stroke of the oil well plunger. Polished rod 736 passes through a sleeve bearing 760, a hydraulic seal 762, and a wiper seal 764 at the bottom of pump chamber 750.

During the upstroke of slave piston 708 and the connected polished and sucker rods, the fluid volume within pump chamber 750 is increased, drawing oil from casing or tubing 754, through transfer line 752 and inlet check valve 751, and into pump chamber 750. During the downstroke of slave piston 708, the fluid volume within pump chamber 750 is decreased, forcing oil out through outlet check valve 757 and production line 756. The pumping motion of wellhead transfer pump 704 is synchronized with the reciprocal motion of the oil well pump so that oil is drawn into pump chamber 750 during the upward, pumping stroke of the oil well plunger, and is pumped out of pump chamber 750, against inlet check valve 751, during the non-pumping downward stroke of the oil well plunger.

The wellhead slave cylinder assembly 702 can be used over a wellhead with or without wellhead transfer pump 704. In either case, it can replace the traditional stuffing box usually required at the top of a well casing. Furthermore, wellhead transfer pump 704 can be used independently of slave cylinder assembly 702. Specifically, transfer pump 704 can be used in conjunction with any mechanism which reciprocally drives an oil well polished rod. The transfer pump need only be located as shown over a wellhead, or with its internal piston operably connected for synchronization with a reciprocating polished rod.

Figure 14:
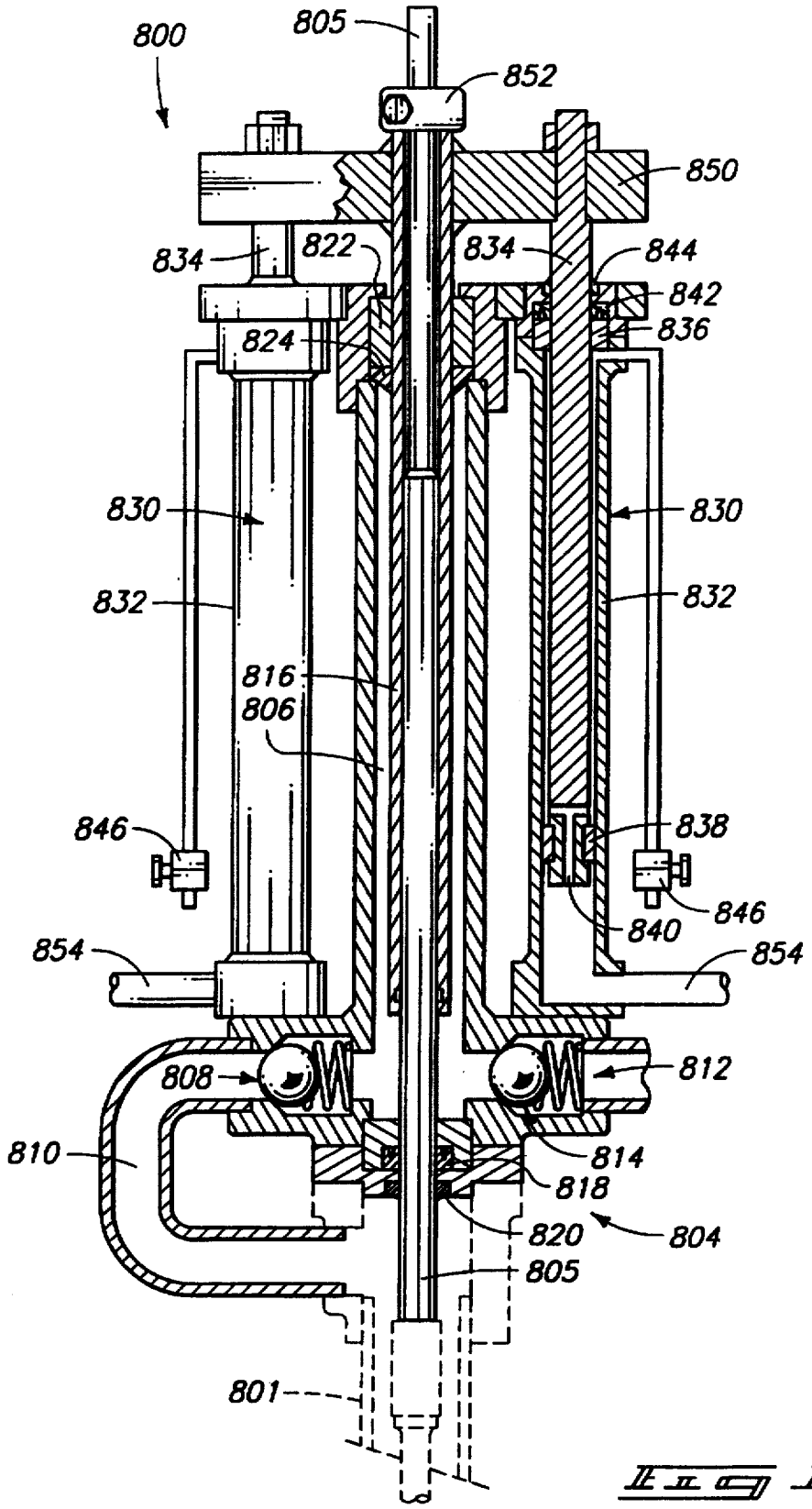
FIG. 14 is a cross-sectional side view of a dual-cylinder wellhead hydraulic cylinder assembly and a wellhead transfer pump in accordance with a preferred embodiment of the invention.

FIG. 14 shows an alternative preferred embodiment dual-cylinder wellhead slave cylinder and piston assembly, generally designated by the reference numeral 800. Wellhead hydraulic assembly 800 is similar to the assembly shown in FIG. 11. However, it utilizes reciprocating pistons rather than the reciprocating cylinders of FIG. 11. In addition, the assembly of FIG. 14 incorporates a wellhead transfer pump similar to that shown in FIG. 13.

Wellhead slave cylinder and piston assembly 800 is mounted directly above a production tube 801. It eliminates the need for a stuffing box. Specifically, assembly 800 includes a wellhead transfer pump 804 through which a polished rod 805 passes. Transfer pump 804 has a cylindrical pump chamber 806 which communicates through an inlet check valve 808 and a transfer line 810 with production tube 801. Pump chamber 806 also communicates with an oil production line 812 through an outlet check valve 814. Inlet check valve 808 allows production oil into pump chamber 806 from the oil well while preventing passage of production oil from pump chamber 806 back into the oil well. Outlet check valve 814 allows production oil to be pumped out of pump chamber 806 and into production line 812, while preventing flow of production oil in the reverse direction or back into pump chamber 806 from production line 812.

A transfer pump piston 816 is slidably received through cylindrical pump chamber 806. Transfer pump piston 816 is cylindrical, having a diameter which is somewhat smaller than the inner diameter of pump chamber 806. Transfer pump piston 816 has a cylindrical bore through its length. Polished rod 805 is received through this bore. Piston 816 is fixed to polished rod 805 to reciprocate with polished rod 805.

A hydraulic seal 818 and a wiper seal 820 are positioned at the bottom of pump chamber 806. A sleeve bearing 822 and a pump seal 824 are similarly positioned at the top of pump chamber 806. Polished rod 805 is slidably received through seals 818 and 820. Pump piston 816 is slidably received through sleeve bearing 822 and pump seal 824.

Transfer pump piston 816 reciprocates with polished rod 805 to vary the internal fluid volume of pump chamber 806. During the upstroke of polished rod 805, the fluid volume within pump chamber 806 is increased, drawing oil from tubing 801, through transfer line 810 and inlet check valve 808, and into pump chamber 806. During the downstroke of polished rod 805, the fluid volume within pump chamber 806 is decreased, forcing production oil out through outlet check valve 814 and production line 812. The pumping motion of wellhead transfer pump 804 is thus synchronized with the reciprocal motion of the oil well pump so that oil is drawn into pump chamber 806 during the upward, pumping stroke of the oil well plunger, and is pumped out of the pump chamber 806, against the inlet check valve 808, during the non-pumping downward stroke of the oil well plunger.

Wellhead hydraulic assembly 800 includes a pair of identical wellhead cylinder assemblies 830 which are laterally spaced from each other about polished rod 805 and transfer pump 804. Each wellhead cylinder assembly 830 has a stationary outer cylinder 832 and a reciprocating slave piston or inner rod 834. Outer cylinders 832 are mounted to wellhead transfer pump 804 above the wellhead. Each outer cylinder 832 has an inner diameter which is slightly larger than the outer diameter of the corresponding inner rod 834. Inner rods 834 are slidably received within outer cylinders 832 to reciprocate vertically in response to a working fluid flow.

An upper sleeve bearing 836 is affixed to the upper end of outer cylinder 832 to provide a sliding inner bearing surface against reciprocating inner rod 834. A split sleeve bearing 838, as described with reference to FIG. 12, is also retained by inner rod 834 between its outer surface and the inner surface of outer cylinder 832. An internal passage 840 in inner rod 834 allows oil to bypass around split sleeve bearing 838 during reciprocation of inner rod 834. A hydraulic seal 842 and a wiper seal 844 are positioned at the top of outer cylinder 832 around inner rod 834. The interior of outer cylinder 832 forms a slave cylinder working chamber having a volume which varies with the vertical displacement of inner rod 834 in relation to stationary outer cylinder 832. Air bleed valves 846 are connected for fluid communication with the slave cylinder working chambers to allow accumulated gas to be discharged from the working chambers. Outer cylinders 832 have oil ports 854 at their lower ends for receiving a working fluid flow from a hydraulic source such as described above.

Inner rods 834 are connected together to reciprocate in unison. A yoke plate 850 extends laterally between inner rods 834 to connect them together at their upper ends. Transfer pump piston 816 is also received through yoke plate 850. Polished rod 805 is connected to yoke plate 850 by a rod clamp 852.

Figure 15:
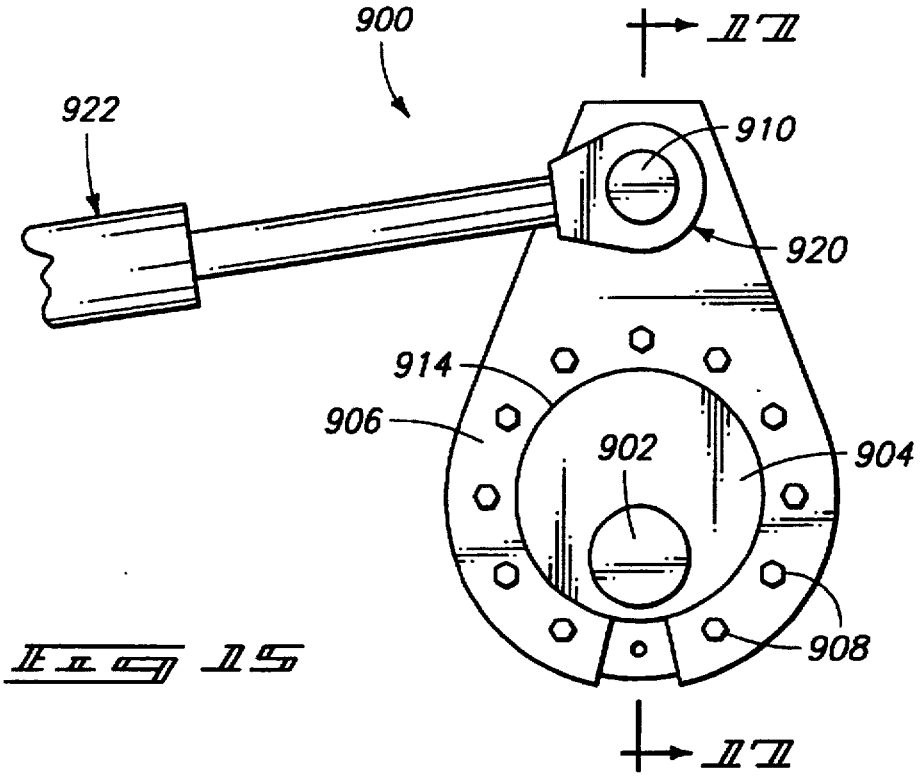
FIG. 15 is a side view of an adjustable throw crank assembly in accordance with a preferred embodiment of the invention, the crank assembly being shown in a first throw setting.
Figure 16:
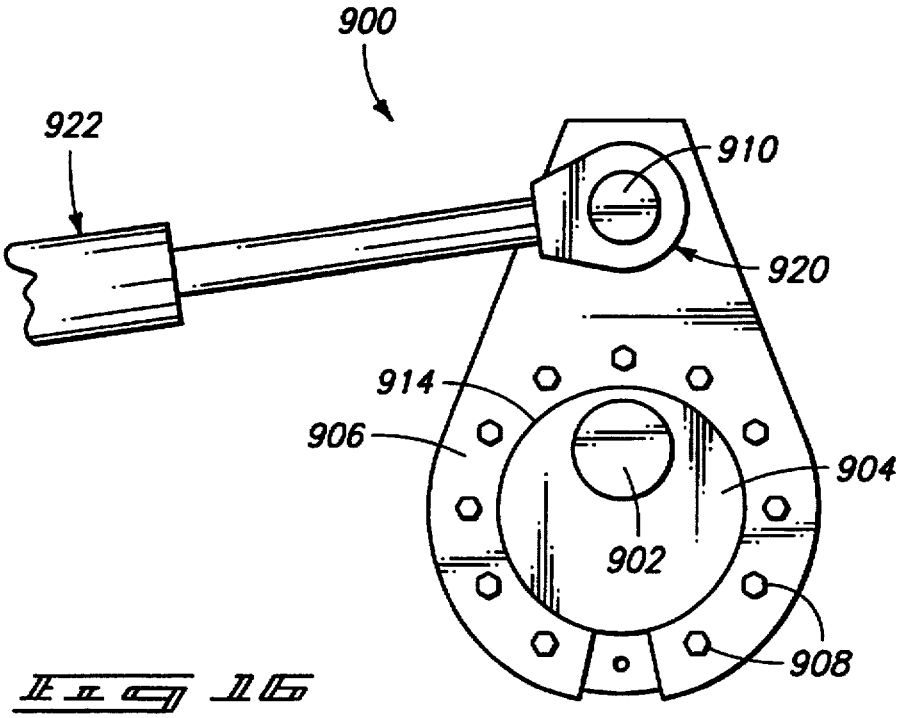
FIG. 16 is a side view of an adjustable throw crank assembly in accordance with a preferred embodiment of the invention, the crank assembly being shown in a second throw setting.
Figure 17:
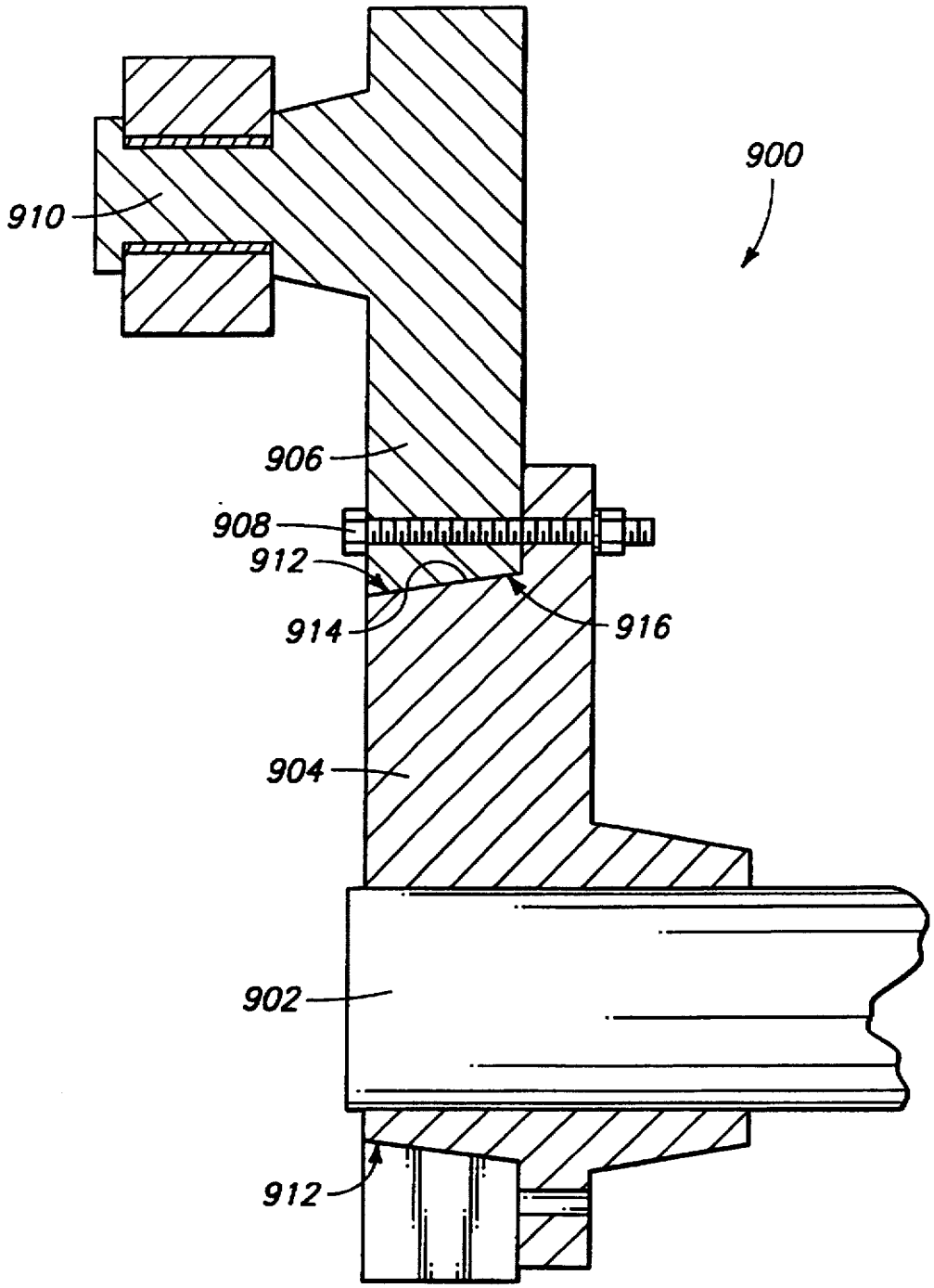
FIG. 17 is a cross-sectional view taken along lines 17—17 of FIG. 15.

FIGS. 15–17 shown an adjustable throw crank assembly 900 which can advantageously be used to drive the master cylinder embodiments described above. Crank assembly 900 includes a powered drive shaft or crankshaft 902 which is rotatably connected to a drive assembly frame. Drive shaft 902 is typically powered by a gearbox such as already described.

Crank assembly 900 includes a circular drive hub 904 which is mounted eccentrically to drive shaft 902. A crank collar 906 is rotatably received over drive hub 904. Crank collar 906 is mounted concentrically to drive hub 904 by a plurality of bolts 908.

More specifically, as shown in FIG. 17, drive hub 904 has a tapered outer surface 912. Crank collar 906 forms a circular aperture 914 with a tapered inner surface 916 which is complementary to outer surface 912 of drive hub 904. Bolts 908 secure crank collar 906 to drive hub 904. The arrangement forms means for securing crank collar 906 in a selected rotational orientation relative to drive hub 904 and for changing the rotational orientation of crank collar 906 relative to drive hub 904.

Crank collar 906 includes a crank pin 910 which is radially offset from crank collar aperture 914 and from drive shaft 902. A pivotal connection 920 of a master cylinder and piston assembly 922 is connected to crank pin 910 to be driven by crank collar 906. The throw of crank pin 910 determines the stroke length of the piston within master cylinder and piston assembly 922. It also determines the stroke length of an associated slave cylinder and piston assembly and of an oil well sucker rod which is driven thereby.

The amount of crank pin offset or throw is determined by the rotational orientation of crank collar 906 relative to drive hub 904. Because of this, the stroke length of the sucker rod can be adjusted or set by adjusting or setting the crank collar relative to the drive hub. This adjusts the crank pin's throw and thereby adjusts the sucker rod stroke length. FIG. 15 shows a comparatively large offset and corresponding stroke length, while FIG. 16 shows a comparatively small offset and corresponding stroke length.

The embodiments described above provide a number of readily apparent advantages over prior art attempts to hydraulically drive an oil well sucker rod. One important characteristic of the drive system is that it produces sucker rod motion which emulates that of a conventional pump jack. This type of motion has proven to be much gentler on sucker rods, prolonging their life greatly over drive systems which rapidly reverse a driving force. Another important characteristic of the drive systems described above is their extreme simplicity. They can be implemented without any electronic control and without complex valving mechanisms. The direct coupling between a master cylinder working chamber and a slave cylinder results in a simplicity which has not previously been suggested. In contrast, prior art attempts have concentrated on more and more complicated hydraulic control schemes which increase cost while decreasing reliability.

Furthermore, the preferred embodiments described above effectively recover leaked hydraulic fluid and function to maintain proper fluid levels within the working and pressure systems, largely without operator monitoring or intervention. The mechanisms described for maintaining the oil levels are simple and reliable. The devices described above are uniquely suited for long periods of unattended operation, such as often encountered in oil well pumping applications.

The unique mounting and driving arrangement for the master cylinder assembly eliminates off-center and angularly-misaligned or torsional forces, thus greatly improving seal and bearing surface life. Because the preferred embodiments utilize displacement master pistons, with seals mounted to the surrounding cylinders, the wearing surfaces are on the cylinders and can be inexpensively resurfaced as necessary. This would not be possible in prior art devices in which the wearing surfaces are on the cylinder walls.

Despite the simplicity of the preferred embodiments, no operational advantages are sacrificed. Stroke length can be easily varied by means of the variable-offset crank assembly. Upper and lower extremes of sucker rod travel can be adjusted by varying the amount of oil contained by the system, or by simply setting the position of an oil injection actuator. Oil replenishment is automatic.

Many variations of the above devices are of course possible, and are intended to fall within the scope of this disclosure. For instance, it is contemplated that a two master hydraulic assemblies might connected to drive a single wellhead hydraulic assembly. Furthermore, more than one master cylinder assembly might be driven by a single gearbox, with each master cylinder assembly being coupled to a different wellhead hydraulic assembly. Coupling between the master assembly and the wellhead assembly can be provided by pipes, tubing, or flexible hose, allowing remote location of the master assembly relative to the wellhead assembly. Such remote coupling is particularly attractive in the context of offshore oil pumping, in which the master hydraulic assembly can be placed on-shore or on a drilling platform, to communicate through flexible hosing with an underwater slave cylinder.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A wellhead hydraulic assembly for operable connection to an oil well sucker rod to reciprocally displace the sucker rod, the wellhead hydraulic assembly comprising:

a hydraulic cylinder;

a rod positioned at least partially within the hydraulic cylinder, the rod having a relief formed thereabout, wherein the rod and the hydraulic cylinder reciprocate linearly relative to each other;

a split cylindrical bearing positioned at least partially in the relief about the rod;

the split cylindrical bearing having an outer bearing surface that slides relative to the inner wall of the hydraulic cylinder.

2. A wellhead hydraulic assembly as recited in claim 1, wherein the split cylindrical bearing comprises two semicircular halves.

3. A wellhead hydraulic assembly as recited in claim 1, wherein the split cylindrical bearing is retained vertically by the relief relative to the rod.

4. A wellhead hydraulic assembly as recited in claim 1, wherein:

the hydraulic cylinder has an inner wall; and the split cylindrical bearing is held in the relief by said inner wall.

5. A wellhead hydraulic assembly as recited in claim 1, wherein:

the hydraulic cylinder has an inner wall;

the split cylindrical bearing is held in the relief by said inner wall; and the split cylindrical bearing is retained vertically by the relief relative to the rod.

6. A wellhead hydraulic assembly for operable connection to an oil well sucker rod to reciprocally displace the sucker rod, the wellhead hydraulic assembly comprising:

a hydraulic cylinder having an inner wall;

a rod having an upper end with a circumferential groove, the rod being positioned to reciprocate linearly relative to the hydraulic cylinder;

a split cylindrical bearing comprising two semicircular halves positioned to be retained vertically by the circumferential groove relative to the rod;

the split cylindrical bearing being held in the circumferential groove by said inner wall of the hydraulic cylinder.

7. A wellhead hydraulic assembly as recited in claim 6, wherein the split cylindrical bearing has an outer bearing surface that slides relative to the inner wall of the hydraulic cylinder.

* * * * *